US008544226B2

(12) United States Patent
Rubel

(10) Patent No.: US 8,544,226 B2
(45) Date of Patent: Oct. 1, 2013

(54) MODULAR INTERIOR PARTITION FOR A STRUCTURAL FRAME BUILDING

(75) Inventor: Zigmund Rubel, Greenbrae, CA (US)

(73) Assignee: Aditazz, Inc., San Bruno, CA (US)

( * ) Notice: Subject to any disclaimer, the term of this patent is extended or adjusted under 35 U.S.C. 154(b) by 0 days.

(21) Appl. No.: 13/420,470

(22) Filed: Mar. 14, 2012

(65) Prior Publication Data

US 2012/0233945 A1 Sep. 20, 2012

Related U.S. Application Data

(63) Continuation-in-part of application No. 13/112,980, filed on May 20, 2011, now Pat. No. 8,245,469.

(60) Provisional application No. 61/452,605, filed on Mar. 14, 2011.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl.
USPC ..... 52/236.6; 52/266; 52/270; 52/317; 52/481.1; 52/745.05

(58) Field of Classification Search
USPC ..... 52/236.3, 266, 290, 293.3, 317, 481.1, 52/483.1, 573.1, 235, 270, 745.05
See application file for complete search history.

(56) References Cited

U.S. PATENT DOCUMENTS

| | | | | |
|---|---|---|---|---|
| 5,127,760 | A | 7/1992 | Brady | |
| 5,755,066 | A | 5/1998 | Becker | |
| 6,295,781 | B1 | 10/2001 | Thompson | |
| 6,412,233 | B1 * | 7/2002 | Jones | 52/92.2 |
| RE39,462 | E | 1/2007 | Brady | |
| 2004/0003564 | A1 * | 1/2004 | Surowiecki | 52/481.1 |
| 2005/0210798 | A1 | 9/2005 | Burg et al. | |
| 2008/0196337 | A1 * | 8/2008 | Surowiecki | 52/241 |
| 2010/0088970 | A1 | 4/2010 | Miller | |
| 2010/0146874 | A1 | 6/2010 | Brown | |
| 2011/0094759 | A1 | 4/2011 | Lopes | |
| 2011/0252719 | A1 | 10/2011 | Wallance | |
| 2011/0296769 | A1 | 12/2011 | Collins et al. | |
| 2011/0296778 | A1 | 12/2011 | Collins et al. | |
| 2011/0296789 | A1 | 12/2011 | Collins et al. | |
| 2012/0000149 | A1 | 1/2012 | Rice | |

OTHER PUBLICATIONS

International Search Report and Written Opinion, PCT/US2012/029119, Mar. 14, 2012.

* cited by examiner

*Primary Examiner* — Brian Glessner
*Assistant Examiner* — Brian D Mattei

(57) ABSTRACT

An interior partition system for a structural frame building is disclosed. The structural frame building has a ceiling line that defines a ceiling height of occupiable space within the structural frame building. The interior partition system includes a first, or upper, modular partition assembly and a second, or lower, modular partition assembly. A receptor structure is configured to connect the first modular partition assembly to the second modular partition assembly. The first modular partition assembly has a vertical dimension that exceeds the ceiling height.

24 Claims, 21 Drawing Sheets

Lower / Install Position

Upper / Final Position

MODULAR INTERIOR PARTITION FOR A STRUCTURAL FRAME BUILDING

CROSS-REFERENCE TO RELATED APPLICATION

This application is entitled to the benefit of provisional U.S. Patent Application Ser. No. 61/452,605, filed Mar. 14, 2011, entitled "Modular Interior Protectable Partitions (IPP) for Buildings," which is incorporated by reference herein.

This application is a continuation-in-part of U.S. patent application Ser. No. 13/112,980, filed May 20, 2011, entitled "Deck Assembly Module for a Steel Framed Building," which is incorporated by reference herein.

FIELD OF THE INVENTION

The invention relates generally to structural framed buildings, and, more specifically to modular components for structural framed buildings.

BACKGROUND

Structurally framed buildings generally include a steel or concrete frame of columns, girders, and beams that support concrete decks. Once installed, the concrete decks form the base of the various floors of the building. Building systems such as walls, facilities components (e.g., electrical, plumbing, and heating, ventilation, and air conditioning (HVAC) components), and equipment are then attached to the concrete deck to finish out the building. In the construction of structurally framed buildings, partitions may be inserted after placing the decks to create separate rooms or compartments on each deck. The various rooms may be tailored for specific uses depending on the position, size or other attributes of the partitions used for the rooms.

Non-load bearing partitions in the interior of a building provide a separation between spaces within the building without necessarily providing support to the building structure. Partitions may need to be resistant to fire, smoke and/or sound transmittance according to the various requirements and usages of the building. Partitions may be built from the floor of one building deck to the underside of the structural deck overhead in a contiguous manner to create a barrier to meet fire, smoke, and/or sound ratings.

SUMMARY

An interior partition system for installation between a lower deck structure and an upper deck structure of a structural frame building is disclosed. The structural frame building has a ceiling line that defines a ceiling height of occupiable space within the structural frame building. The interior partition system includes a first, or lower, modular partition assembly for connection to the lower deck structure along a lower edge of the first modular partition assembly, and a second, or upper, modular partition assembly for connection to the upper deck structure along an upper edge of the second modular partition assembly. The interior partition system also includes a receptor structure configured to connect an upper edge of the first modular partition assembly to a lower edge of the second modular partition assembly. The first modular partition assembly has a vertical dimension that exceeds the ceiling height, such that the upper edge of the first modular partition assembly, the lower edge of the second modular partition assembly, and the receptor structure are located above the ceiling line upon installation of the first modular partition assembly, the second modular partition assembly, and the receptor structure in the structural frame building.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements. Additionally, in some cases, reference numbers are not repeated in each figure in order to preserve the clarity and avoid cluttering of the figures.

DETAILED DESCRIPTION

Figure 1:
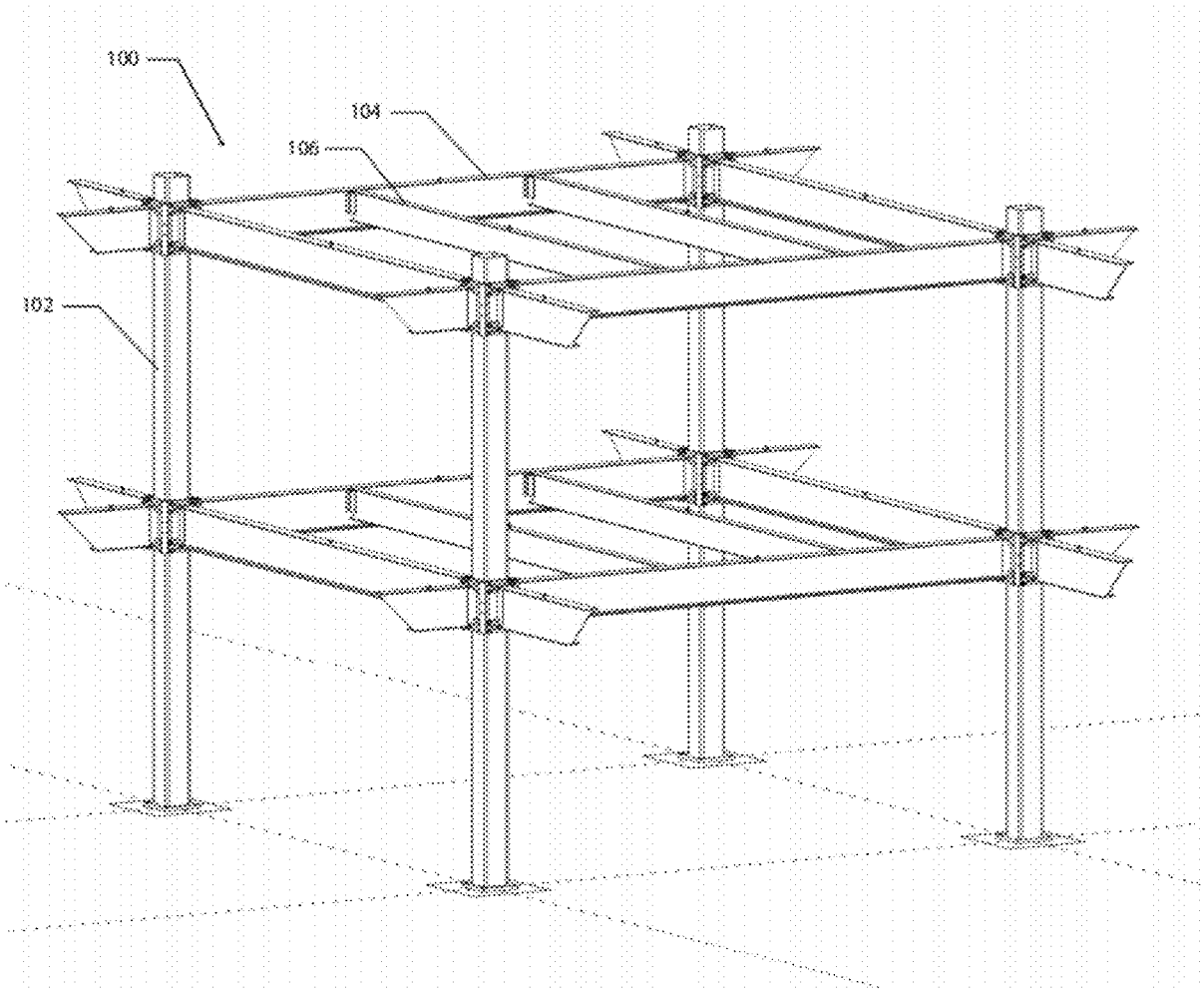
FIG. 1 depicts a perspective view of one embodiment of a structural frame of a framed building.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

While many embodiments are described herein, at least some of the described embodiments present a system and method for constructing an occupiable space in a structural frame building. More specifically, the system is an interior partition system that uses modular partition assemblies to create occupiable spaces on a deck of a structural frame building. In one embodiment, the occupiable spaces are occupied by people and/or objects. The partition assemblies exceed a ceiling height and include upper and lower modular partition assemblies connected by a receptor structure above the ceiling height.

Several variables or issues may affect the construction of a structural frame building. For example, the top portion of a full height wall in the interior of a structural frame building is referred to as the "head of wall condition." The head of wall condition exists at fire, smoke, and/or sound rated walls and because of variations in the design and construction of concrete decks, the head of wall condition may need to be evaluated individually in each steel framed building to ensure that applicable fire, smoke, and/or sound ratings are met. Acoustical properties may be measured using a sound transmission coefficient and correlate to decibel reduction of noise as it is transmitted through a partition. Fire and smoke resistance ratings may are properties of time, generally between forty-five minutes and four hours that partitions resist the transmission of fire or smoke from one side of the partition to the other.

Additionally, the anchoring of building systems, such as interior walls, facility components, and equipment to concrete decks is typically customized for each individual structural frame building. Further, the onsite customization of anchoring systems does not typically take into account any future needs and/or uses of the steel frame building.

In some conventional structural frame buildings, partitions are typically "stick" built or pre-assembled in panels in an offsite fabrication shop and brought to the site. Coordinating the design of the partition assemblies, internal utility routings, and anchoring/bracing to ensure that the requirements of the many components in combination are met can require tremendous effort. The assembly of the many different components can require valuable resource process time to be expended on each design and construction project that is often lost on future projects and has to be repeated, sometimes with similar errors.

FIG. 1 depicts a plan view of one embodiment of a structural frame 100 of a framed building. The structural frame 100 may include columns 102—which are generally vertical to the surface on which the building sits—and girders 104 and other support beams 106, which are generally horizontal to the surface on which the building sits. Structural frames 100 and framed buildings are well known in the field.

In one embodiment, the structural frames 100 are steel frames. In one embodiment, the columns 102 are "I" shaped steel beams, referred to as "I-beams". In general, the I-beams may be spaced apart in a grid structure that includes an X-span dimension and a Y-span dimension. For example, X and Y spans in the range of 10-70 feet and X and Y spans in the range of 20-40 feet are common, though other dimensions are possible. The structural frames 100 may be any type, shape, or material used for framing the framed building. The material for the framed building may include a composite of more than one material.

The spacing of the girders 104 may be determined by the spacing of the columns 102. The spacing of the beams 106 may be more flexible than the spacing of the girders 104. The beams 106 may be located between pairs of columns 102, and additional beams 106 may be located between columns 102.

Figure 2:
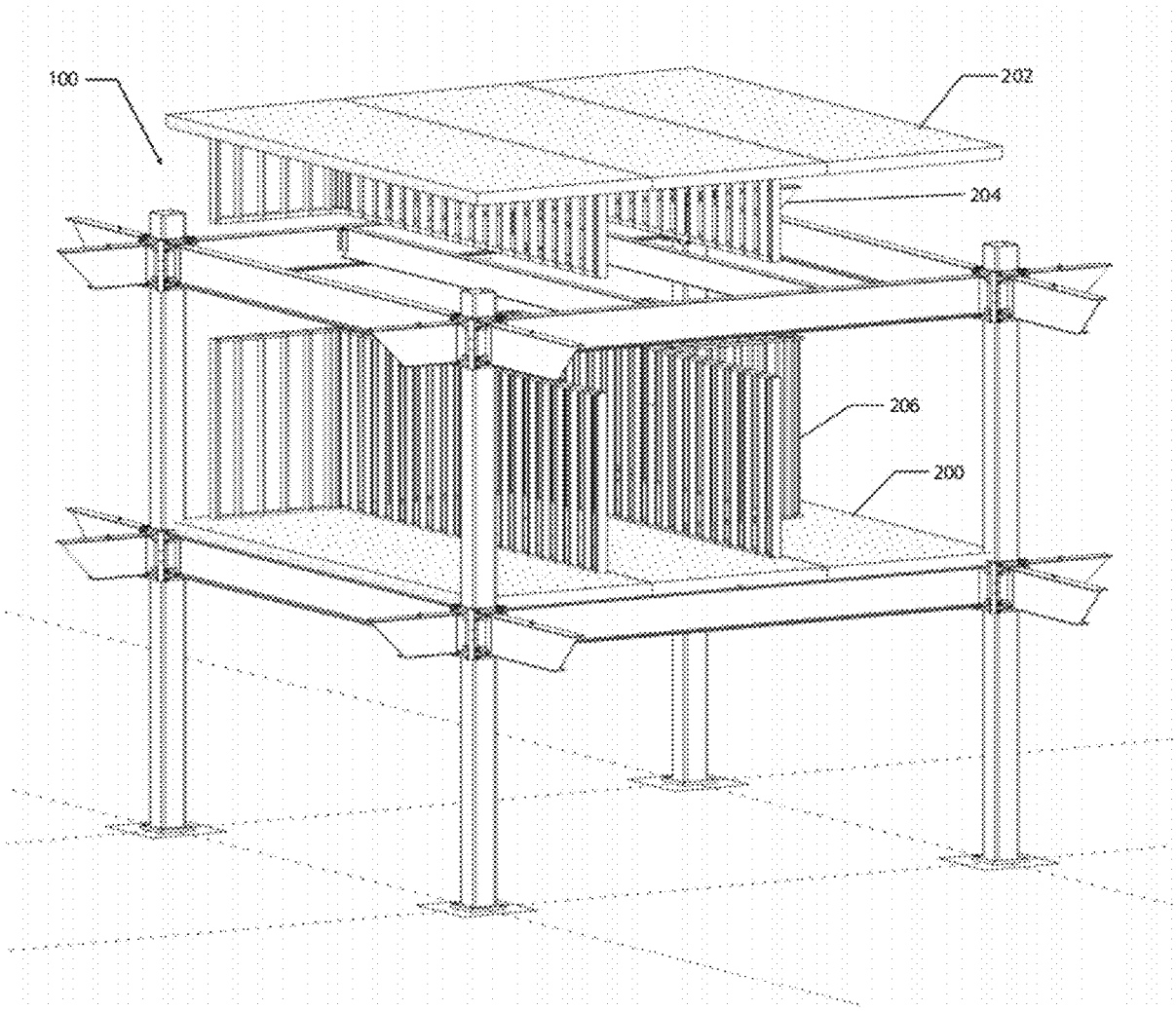
FIG. 2 depicts a perspective view of one embodiment of deck structures in the framed building of FIG. 1.

FIG. 2 depicts a plan view of one embodiment of deck structures in the framed building of FIG. 1. After the structural frame 100 of the framed building has been assembled, the deck structures—also referred to herein as "decks"—for the framed building may be installed. In one embodiment, the decks include concrete deck assembly modules that are positioned in accordance with the positioning of the columns 102, girders 104, and beams 106 so that the decks are supported by the structural frame 100.

In one embodiment, the structural frame 100 is a frame that defines a footprint of an occupiable building. The structural frame 100 includes at least one lower deck structure 200 located within the footprint of the frame and at least one upper deck structure 202 located within the footprint of the frame and supported by the building frame. An interior partition system is installed between the lower deck structure 200 and the upper deck structure 202 to define an occupiable space. Partition assemblies may be attached to the upper and lower decks 202, 200 to create occupiable spaces in the framed building. In an embodiment, the interior partition system includes partition assemblies that are not exposed to the outside environment, but are contained within an interior space of the framed building.

In various embodiments, the concrete decks may be prefabricated and assembled onsite or formed onsite in the structural frame 100. The shape of the decks may be determined by the shape and positioning of the columns 102, girders 104, and beams 106 of the structural frame 100, as well as the location of the decks in the structural frame 100. Additionally, the spacing between the decks may include space for habitation spaces as well as any utility routings, anchors, braces, or other components needed for the operation or structure of the building. In one embodiment, the exact size and shape of the decks is governed in part by at least one of the following parameters: structural performance requirements of the structural frame 100; the framing geometry of the structural frame 100; transportation requirements of the jurisdictions in which the decks are transported on public roads; and vehicle availability for transport.

Figures 3A, 3B, 3C:
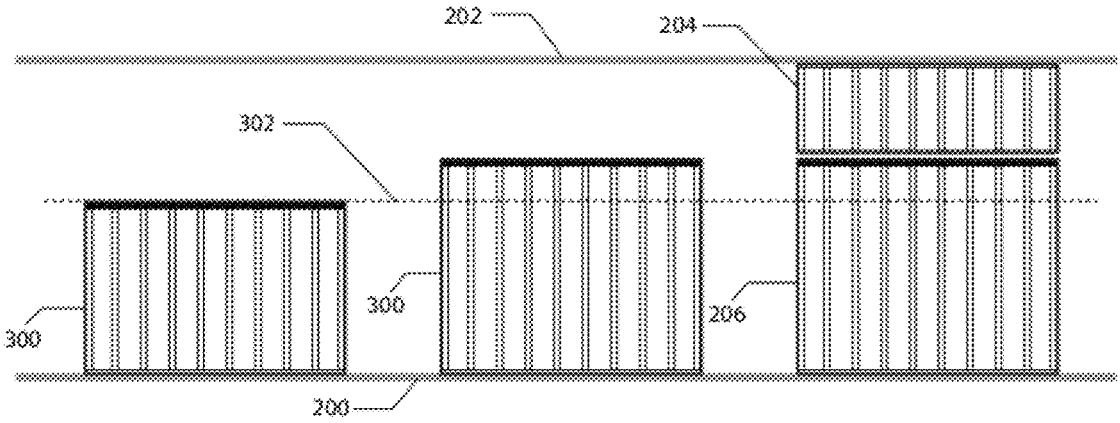
FIGS. 3A-3C depict side views of embodiments of modular partition assemblies between decks in the framed building of FIG. 1.

FIGS. 3A-3C depict side views of embodiments of modular partition assemblies 300 between decks in the framed building of FIG. 1. FIGS. 3A and 3B depict conventional interior partitioning systems that include a single partition assembly. FIG. 3C depicts a modular partitioning system according to the principles described herein.

The interior partitioning system of FIG. 3A has a vertical dimension equal to or approximately equal to a ceiling line 302 between a lower deck 200 and an upper deck 202. The ceiling line 302 may be determined by the structural ceiling visible within the habitation space defined by the partition assemblies. The ceiling line 302 may define a ceiling height of occupiable space within the structural frame building. In an embodiment, the ceiling line 302 is in the range of 8-10 feet from the lower deck 200. For example, a ceiling line 302 at 8 feet is common. The space above the ceiling line 302 and below the upper deck 202 may include utilities, ducts, electrical lines, and/or other components that are not visible from within the habitation space. The interior partitioning system of FIG. 3B has a vertical dimension above the ceiling line 302.

The interior partitioning system of FIG. 3C includes two modular partition assemblies—an upper partition assembly 204 and a lower partition assembly 206. The upper partition assembly 204 is attached to the upper deck 202, and the lower partition assembly 206 is attached to the lower deck 200. In one embodiment, the vertical distance between the lower deck 200 and the upper deck 202 is in the range of 11-25 feet, the ceiling line 302 is in the range of 7-11 feet, the vertical dimension of the lower modular partition assembly is in the range of 8-12 feet, and the vertical dimension of the upper modular partition assembly is in the range of 3-12 feet. In one embodiment, the upper and lower partition assemblies 204, 206 are non-load bearing and form non-load bearing walls. Non-load bearing partitions and/or walls are structures of the framed building that are not necessary to support the structural load of the framed building by conducting weight to a foundation structure of the framed building, though non-load bearing walls may bear some load within the structural frame 100.

Figures 4A, 4B, 4C:
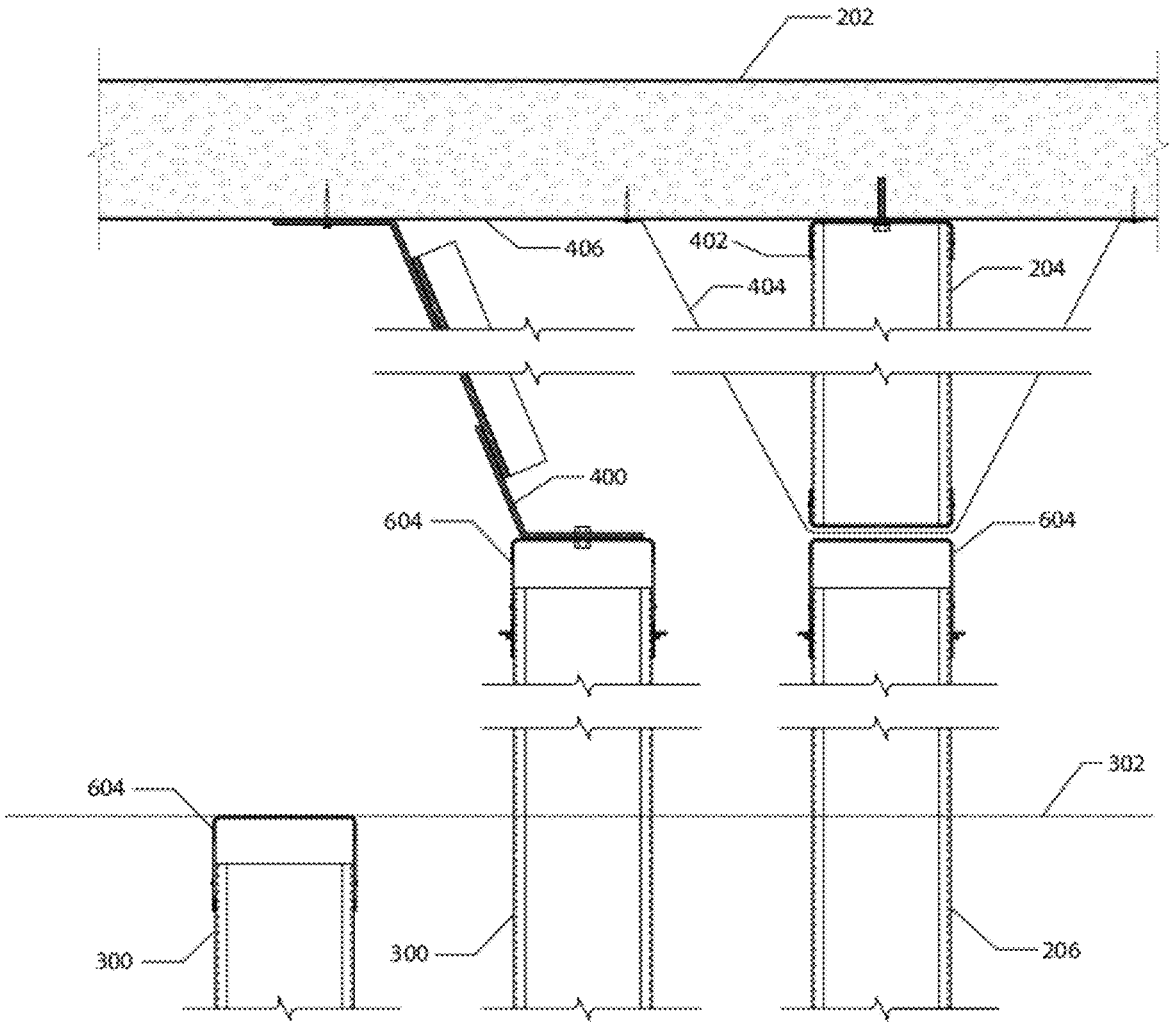
FIGS. 4A-4C depict end views of embodiments of partition heads of the modular partition assemblies of FIGS. 3A-3C.

FIGS. 4A-4C depict end views of embodiments of partition heads of the modular partition assemblies 300 of FIGS. 3A-3C, respectively. The partition head of FIG. 4A includes a conventional partition assembly with a vertical dimension approximately at the ceiling line 302. The partition assembly may be attached to the ceiling using a receptor structure 604 or other fastener at an upper edge of the partition head. The partition assembly may be fastened to a floor on the lower deck 200 using a similar fastener.

The partition head of FIG. 4B includes a conventional partition assembly with a vertical dimension above the ceiling line 302. The partition assembly may be fastened above the ceiling to a bottom surface 406 of the upper deck 202 or to some portion of the ceiling using any fastening method, such as a brace 400 with a heavier gauge than the panels of the modular partition assemblies 300. As shown, the partition assemblies 300 of FIGS. 4A and 4B leave a space between the partition head and the bottom surface 406 of the upper deck 202. This space may not meet applicable fire, smoke, or noise ratings because the fire, smoke, or noise may pass through the space above the partition assemblies.

The partition head of FIG. 4C includes upper and lower modular partition assemblies 204, 206. In one embodiment, at least a portion of the lower partition assembly 206 extends above the ceiling line 302, and the upper partition assembly 204 may be contained entirely above the ceiling line 302. The upper partition assembly 204 may be attached to the bottom surface 406 of the upper deck 202 using a horizontal track 402 or other fastener. The fastener used to attach the upper partition assembly 204 to the upper deck 202 may be fire/sound rated to help prevent fire, smoke, or noise from passing through the partition assemblies. The lower partition assembly 206 may be attached to a top surface or floor of the lower deck 200 using a similar horizontal track 402 or fastener.

The upper partition assembly 204 is connected to the lower partition assembly 206 by a receptor structure 604 at a receptor joint to form a single modular partition or panel that fully extends from the lower deck 200 to the upper deck 202. The upper partition assembly 204 has a vertical dimension that exceeds the ceiling height. The upper partition assembly 204 may include an upper receptor structure at a lower edge of the upper partition assembly 204 that attaches to a lower receptor structure at the upper edge of the lower partition assembly 206. The upper edge of the lower partition assembly 206, the lower edge of the upper partition assembly 204, and the receptor structures 604 are positioned above the ceiling line 302. In some embodiments, the partition assemblies 204, 206 include a brace 400 or metal strap 404 that is positioned between or in accordance with the lower receptor structure and the upper receptor structure and attaches to the bottom surface 406 of the upper deck 202. The brace 400 may provide additional structural support for the partition assemblies 204, 206. Because the partition assemblies 204, 206 of FIG. 4C include a head that fully extends to the bottom surface 406 of the upper deck 202, the partition assemblies 204, 206 may meet the requirements for the fire, smoke, or noise ratings for the head of wall condition. Other standards or ratings may apply to which the partition assemblies 204, 206 conform.

Figure 5:
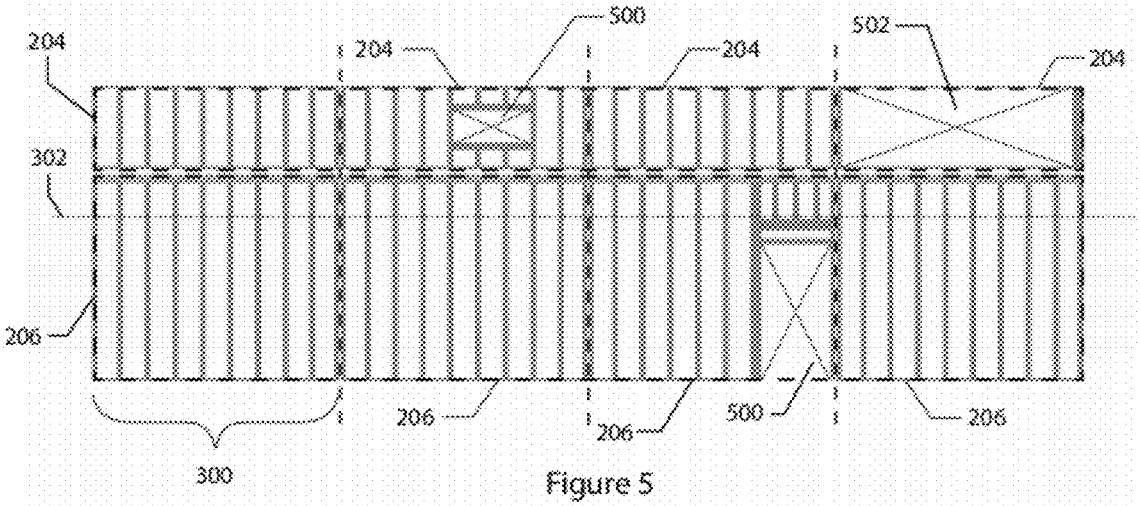
FIG. 5 depicts a side view of one embodiment of an interior partition system between decks in the framed building of FIG. 1.

FIG. 5 depicts a side view of one embodiment of an interior partition system between decks in the framed building of FIG. 1. In one embodiment, the interior partition system includes modules that form habitation spaces between the lower deck 200 and the upper deck 202. The modules may be created using modular partition assemblies 300 at one or more sides of the habitation space. In some embodiments, the habitation spaces may have walls formed by a combination of any of load-bearing walls, exterior walls, non-load bearing walls, and interior partition assemblies as described herein.

Modules formed using the interior partition assemblies may be rectangular, square, or a custom shape defined by the partition assemblies. The modules may share walls formed by partition assemblies. In some embodiments, multiple partition assemblies may form a single wall, thus allowing the customization of the size and shape of each module. The modular partition assemblies 300 may include openings 500 for doors, windows, vents or other utilities and components in either the upper or lower partition assemblies 204, 206.

After the modular partition assemblies 300 have been attached to the upper deck 202 and the lower deck 200 and to other modular partition assemblies 300, drywall, plaster, and/or other finishings may be applied to the modular partition assemblies 300, and the structural frame building may be finished. The type of sheathing used to cover the partition assemblies may be dependent on the specific requirements of the structural requirements and/or use of the space that is enclosed by the partition system. The partition assemblies may receive sheet metal backing plates 502 in some embodiments.

In one embodiment, many of the in-wall utilities are placed in the lower partition assemblies 206, including piping, electric and low voltage services, and other utilities. The utilities may be routed horizontally, vertically, or both horizontally and vertically. Other routing directions may also be used. Larger utility openings 500 and penetrations may be included in the upper partitions assemblies above the ceiling line 302. The modular partition assemblies 300 may include an anchorage area for wall-hung equipment or accessories, particularly on the lower partition assemblies 206 below the ceiling line 302. The modular partition assemblies 300 may help streamline overhead mechanical, electrical, and plumbing coordination by providing predictable locations for bracing and other secondary structure members.

Figure 6:
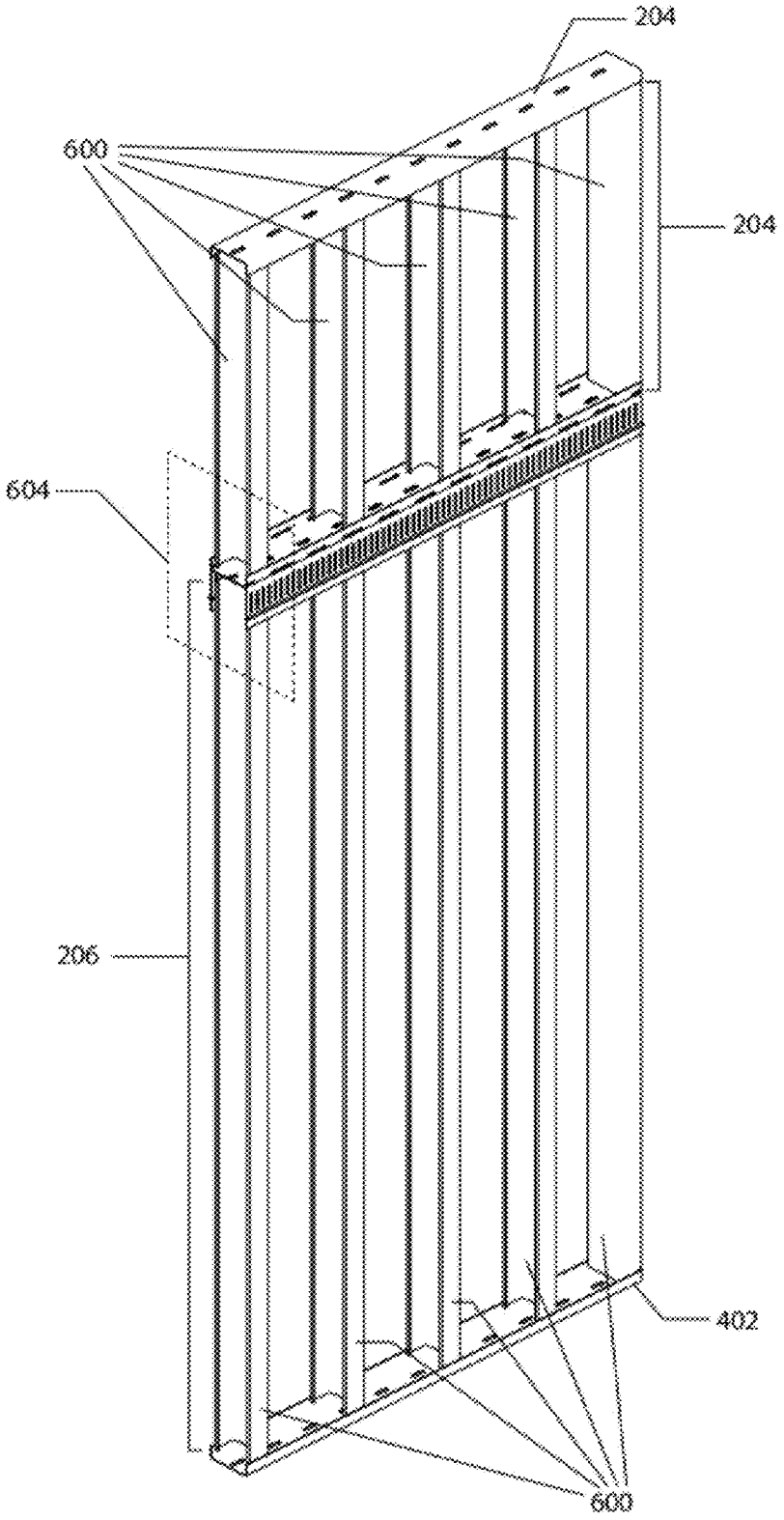
FIG. 6 depicts a perspective view of one embodiment of an interior partition system.

FIG. 6 depicts a perspective view of one embodiment of an interior partition system. The interior partition system includes an upper partition assembly 204 and a lower partition assembly 206 with a receptor structure 604. In one embodiment, the modular partition assemblies 300 are made offsite and shipped to the construction site for installation. Each of the upper partition assembly 204 and the lower partition assembly 206 may be made using several framing members. The framing members in each of the upper partition assembly 204 and the lower partition assembly 206 include a series of parallel vertical studs 600 and horizontal tracks 402. The lower partition assembly 206 includes vertical studs 600 that sit in a lower horizontal track 402. The vertical studs 600 may be fixed to the lower horizontal track 402 before shipping the partition assemblies to the construction site.

The upper and lower partition assemblies 204, 206 are joined at a semi mid-span receptor joint that accommodates inter-story vertical deflection movement when the loading and/or movement of one floor is different than the others, as well as accommodating deviations in on-site construction techniques. The receptor joint may also provide flexibility of the upper and lower components to be joined. This may include shifting the deflection movement of full height partitions from the head of wall to the mid-span, allowing for a site adaptable, tight, non-moving connection that may be made more simply than making the connection and providing movement at the head of wall. The receptor joint may be placed along a datum height on the floor. The datum height provides a point of reference for the lower and upper partition assemblies 204 to be installed. The receptor structure 604 may provide traditional double track deflection or slotted track deflection. The receiving track for the lower partition assembly 206 may allow for non-regular floor-to-floor height.

The location and structure of the interior modular partition assemblies 300 may be determined using an automated process. Each panel using the modular partition assemblies 300 may be interchangeable with other panels. Changes in the design or construction of the partition assemblies may be easier to incorporate than conventional systems because the panels are made with a regularized centered dimensioning system (for example, 2", 3", 4" or 5") to meet the unique needs of the specific installations.

In one embodiment, the horizontal spacing of the vertical studs 600 is configured such that the partition resists flexural movement in the drywall, as well as the orthogonal deflection in the partition. For example, the horizontal spacing may be no more than twenty-four inches on center. In some embodiments, studs 600 may be place directly adjacent to one another proximate an opening 500 in the panel and fastened together to add additional support.

The framing members may be fastened to each other by screwing, pinching, punching or welding the individual pieces based on the structural requirements of the modular partition assemblies 300. Anchoring the partition assemblies to the building structure may be determined based on site-specific needs.

In one embodiment, each modular partition assembly has a minimum width of 6 inches and a maximum width of 25 feet. In some embodiments, partition assemblies having a width wider than 25 feet may require a control joint for proper installation. In one embodiment, each of the upper and lower partition assemblies 204, 206 has a maximum height of 10-20 feet.

Figure 7A:
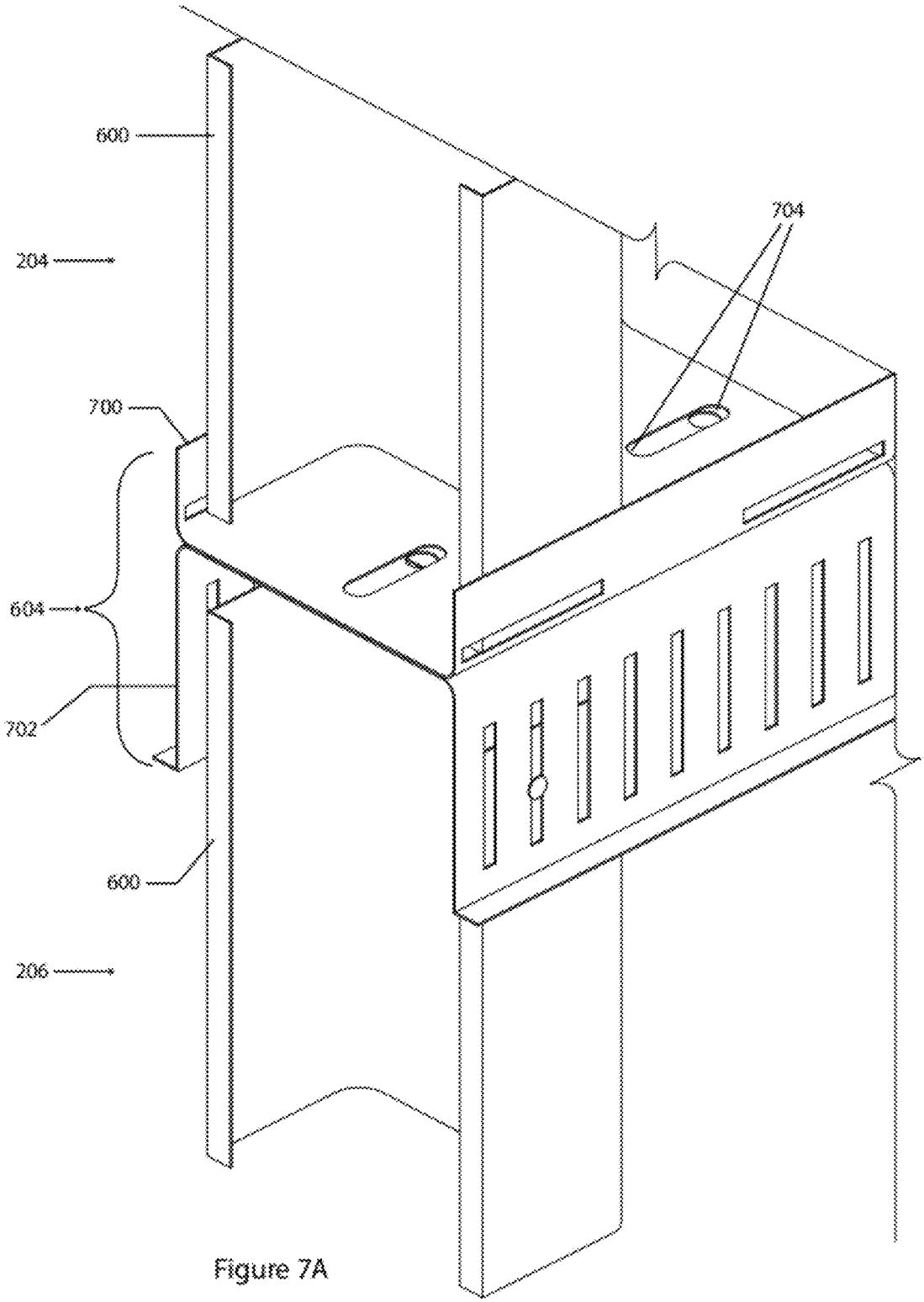
FIG. 7A-7C depict perspective, cross-section, and side views of embodiments of receptor structures connecting the modular partition assemblies of the interior partition system of FIG. 6.
Figure 7B:
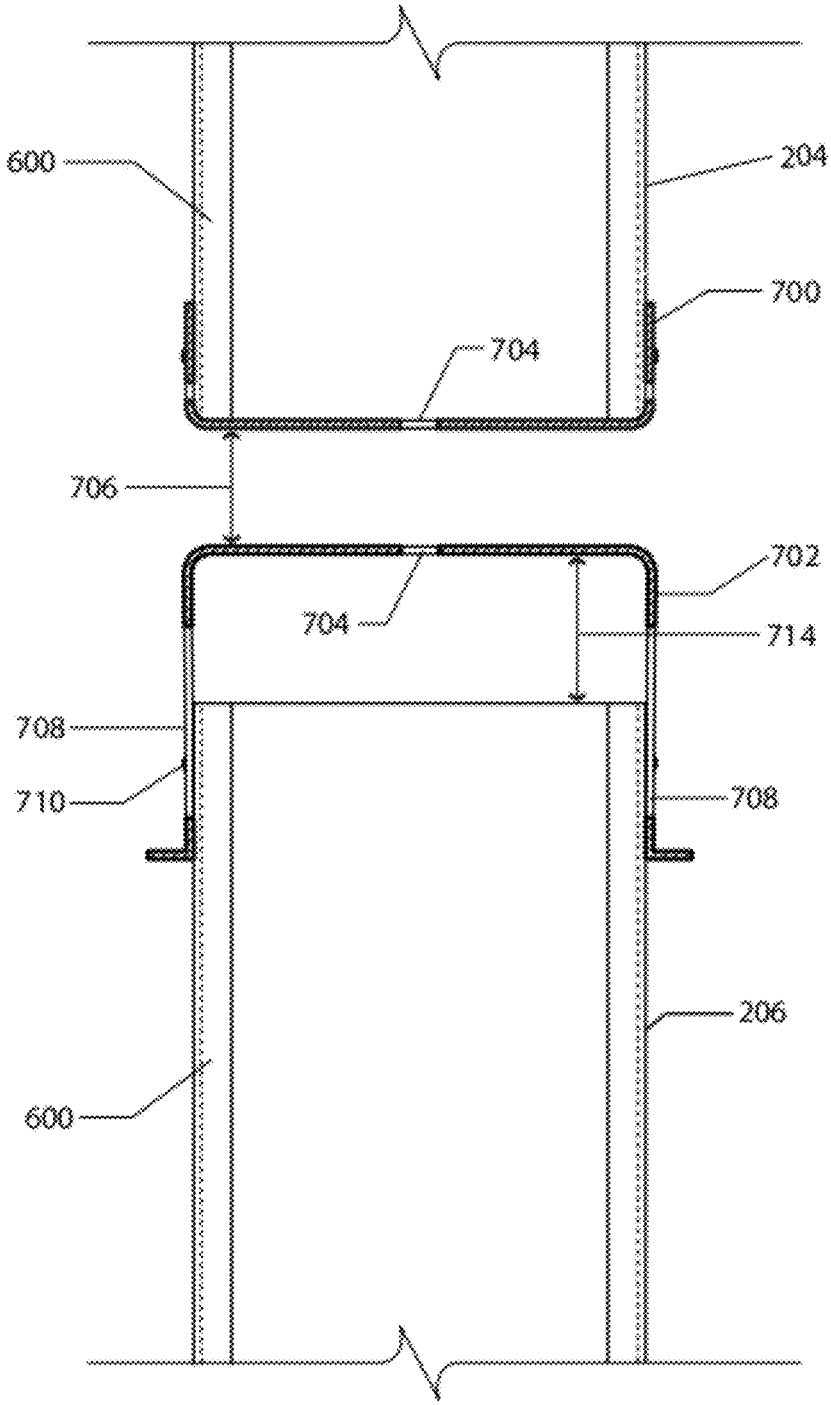
Figure 7C:
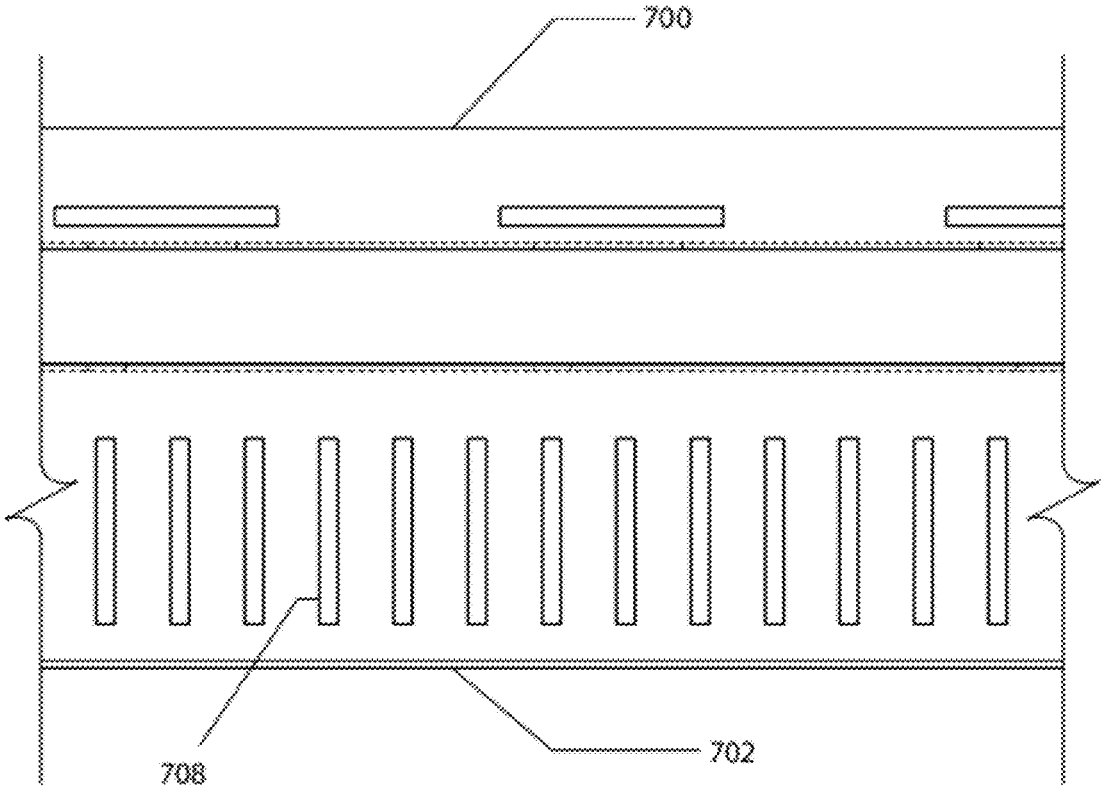

FIG. 7A-7C depict perspective, cross-section, and side views of embodiments of receptor structures 604 that are used to connect the modular partition assemblies 204, 206 of FIG. 6. FIG. 7A depicts a perspective view of the receptor structures 604 at the mid-span receptor joint between the upper partition assembly 204 and the lower partition assembly 206.

The upper partition assembly 204 includes an upper receptor structure 700 at a lower edge of the upper partition assembly 204. The lower partition assembly 206 includes a lower receptor structure 702 at an upper edge of the lower partition assembly 206. In some embodiments, the upper receptor structure 700 and the lower receptor structure 702 may be joined to the upper partition assembly 204 and the lower partition assembly 206, respectively. In one embodiment, the lower receptor structure 702 is adjustably connected to the lower partition assembly 206, while the upper partition assembly 204 may not be fixed to the upper receptor structure 700, but rather sits in the upper receptor structure 700. Furthermore, the upper receptor structure 700 and the lower receptor structure 702 may be fastened together to fix or partially fix the upper partition assembly 204 with respect to the lower partition assembly 206. The upper and lower receptor structures 700, 702 may be fastened together through holes 704 or slots in the adjoining surfaces of the upper and lower receptor structures 700, 702.

FIG. 7B depicts an end cross-section view of one embodiment of the receptor structures 604 connecting the upper and lower modular partition assemblies 204, 206, and FIG. 7C depicts a side view of the same embodiment. The gap 706 shown in the present embodiment may be present when the receptor structures 604 are first positioned on the respective partition assemblies. In some cases, the gap 706 may be cause by variations in distance between the lower deck 200 and the upper deck 202 due to various construction variables or imperfections.

Vertical slots 708 in the lower receptor structure 702 allow the lower receptor structure 702 to be raised or lowered before fastening the lower receptor structure 702 to the vertical stud 600 with a fastener 710 within one of the vertical slots 708. In one embodiment, the lower receptor structure 702 is fastened to the vertical stud 600 according to an adjustable vertical position of the lower receptor structure 702 relative to a fixed position of the lower partition assembly 206.

Because the lower receptor structure 702 is adjustably connected to the lower partition assembly 206, a vertical position 714 of the lower receptor structure 702 may be adjusted to allow the lower receptor structure 702 to abut the lower receptor structure 702, after which the lower receptor structure 702 may then be fastened to the lower partition assembly 206 and to the upper receptor structure 700.

FIGS. 8A-8G depict perspective, cross-section, developed plan, and undeveloped plan views of embodiments of a lower receptor structure 702. The lower receptor structure 702 may be used in conjunction with the modular partition assemblies 300 as described herein, though the lower receptor structure 702 may be used in conjunction with any partitioning systems. The lower receptor structure 702 includes a number of slots in both sides of the lower receptor structure 702. The slots allow the lower receptor structure 702 to be lowered or raised according to a distance between the lower partition assembly 206 and the upper partition assembly 204 after installation in the structure frame building. In one embodiment, a fastener 710 is inserted into a slot 708 that aligns with a hole in the vertical stud 600 after adjusting the lower receptor structure 702 to a desired vertical position 714 relative to the lower partition assembly 206. In some embodiments, a hole may be punched or created in the vertical stud 600 after the lower receptor structure 702 is adjusted to the desired vertical position 714.

In one embodiment, the lower receptor structure 702 includes a tab 800 on each side of the lower receptor structure 702. As shown in the embodiments of FIGS. 8F and 8G, the tabs 800 are configured as sheathing stops that may fit at least partially between sections of wall sheathing 808, such as drywall, positioned next to the upper partition assembly 204 and the lower partition assembly 206. The position of the tabs 800 in conjunction with the sheathings 808 may provide improved performance to meet certain fire, smoke, or noise ratings requirements. The tabs 800 may be a lighter gauge than the rest of the lower receptor structure 702. A sealant 810, such as an elastic, fire resistant sealant, may be applied between the sections of sheathing 808 above and below the tabs 800 to provide additional improvements to fire or other ratings for the partition assemblies. A metal angle 806, such as a gypsum wall board trim piece, may be positioned under the tabs 800 to provide a boundary where the sealant 810 rests to complete a fire/acoustical boundary system that meets certain fire/sound ratings. The receptor joint may also include a backer rod 812 to reduce the amount of volume of sealant 810 required to fill the space between the sections sheathing 808, which may reduce the cost of constructing the partitioning system. Other embodiments of tabs 800 may be used in conjunction with the lower receptor structure 702.

Figure 8A:
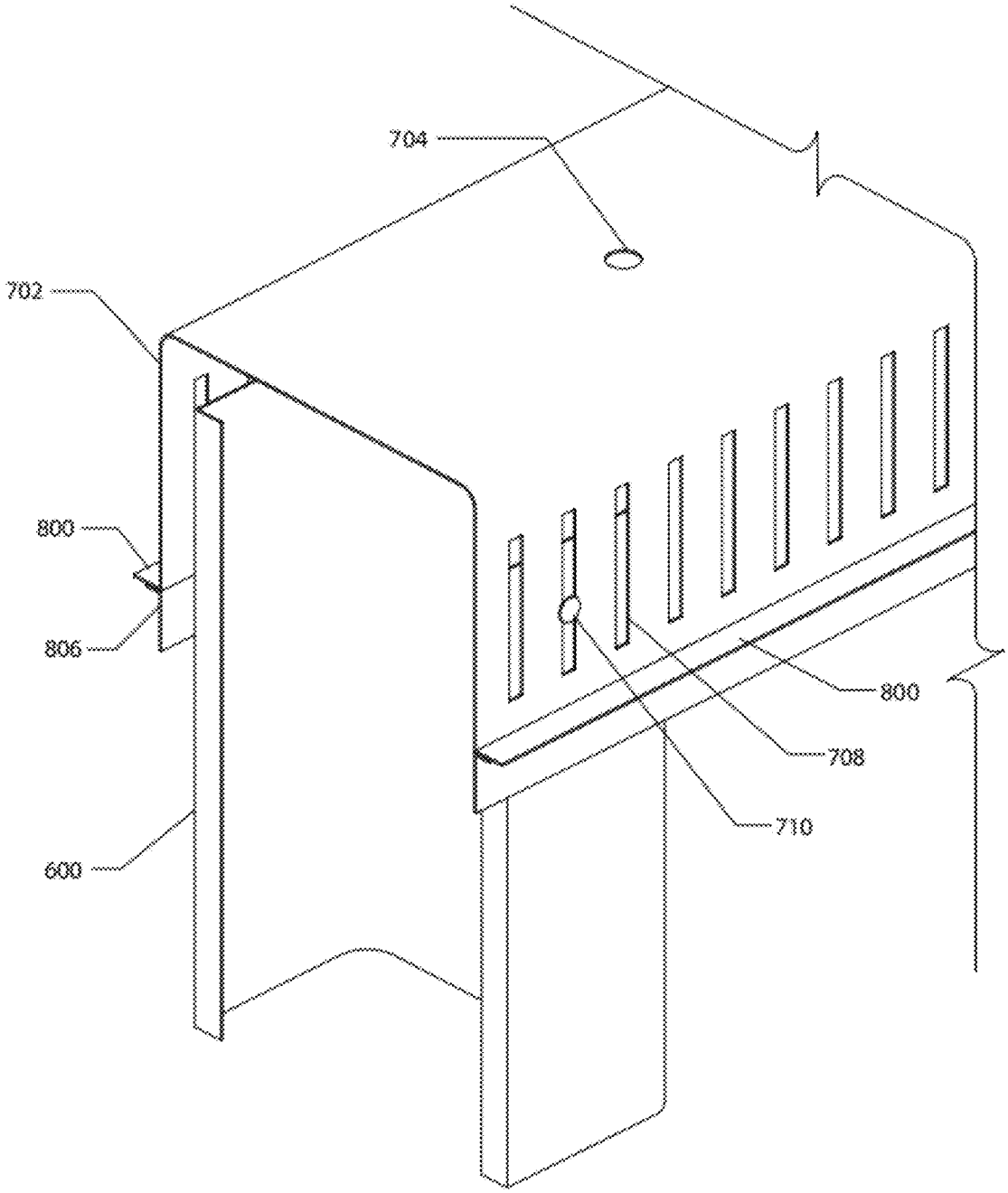
FIGS. 8A-8G depict side, perspective, cross-section, developed plan, and undeveloped plan views of embodiments of a lower receptor structure.
Figure 8B:
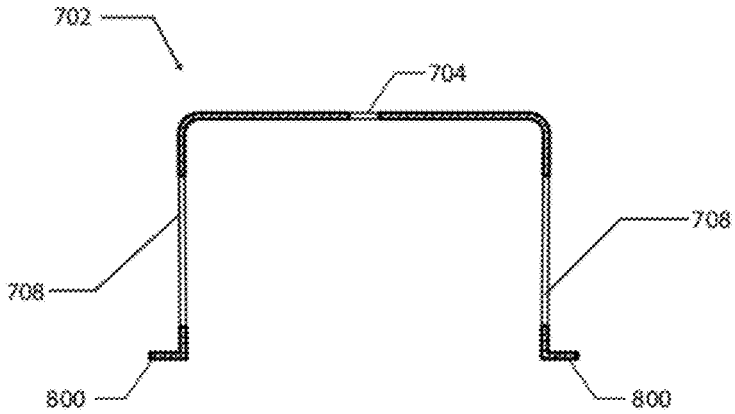
Figure 8C:
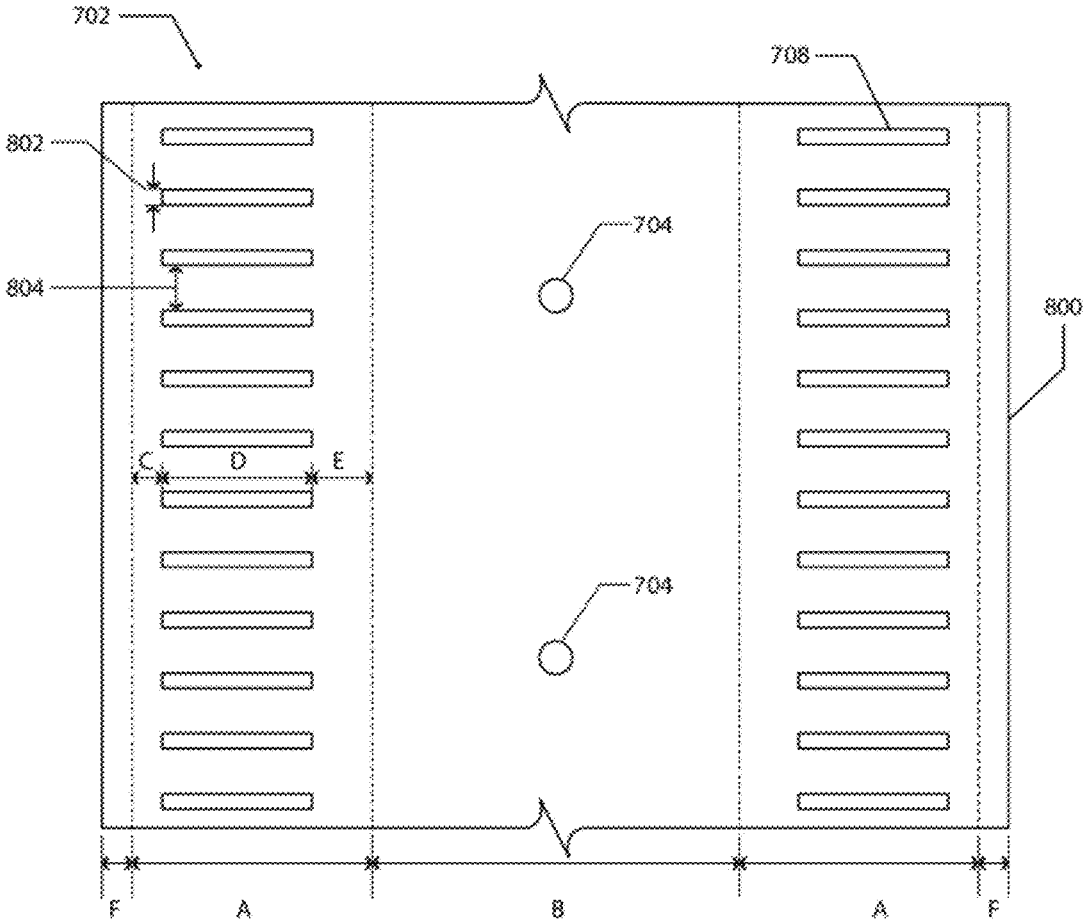
Figure 8D:
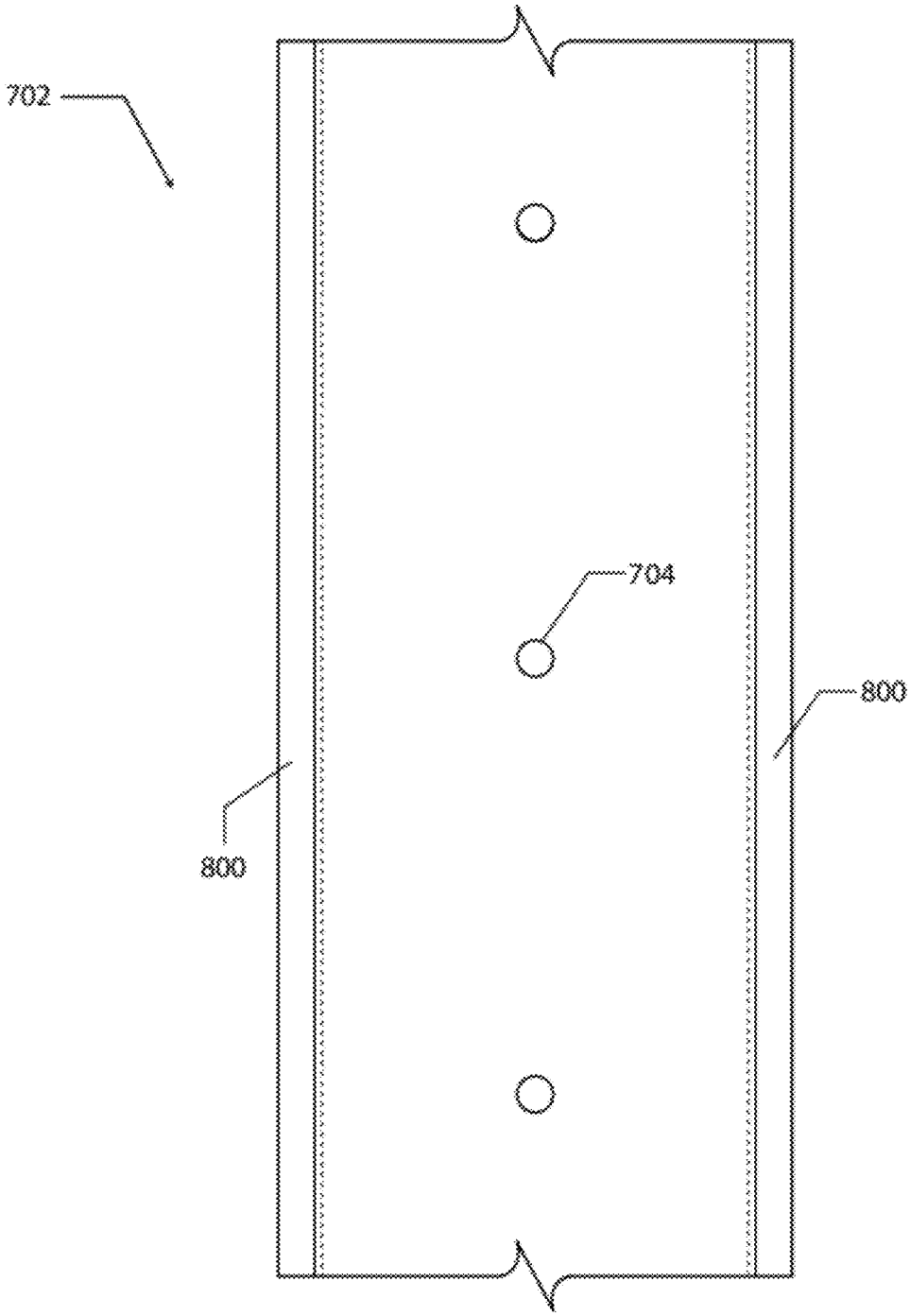
Figure 8E:
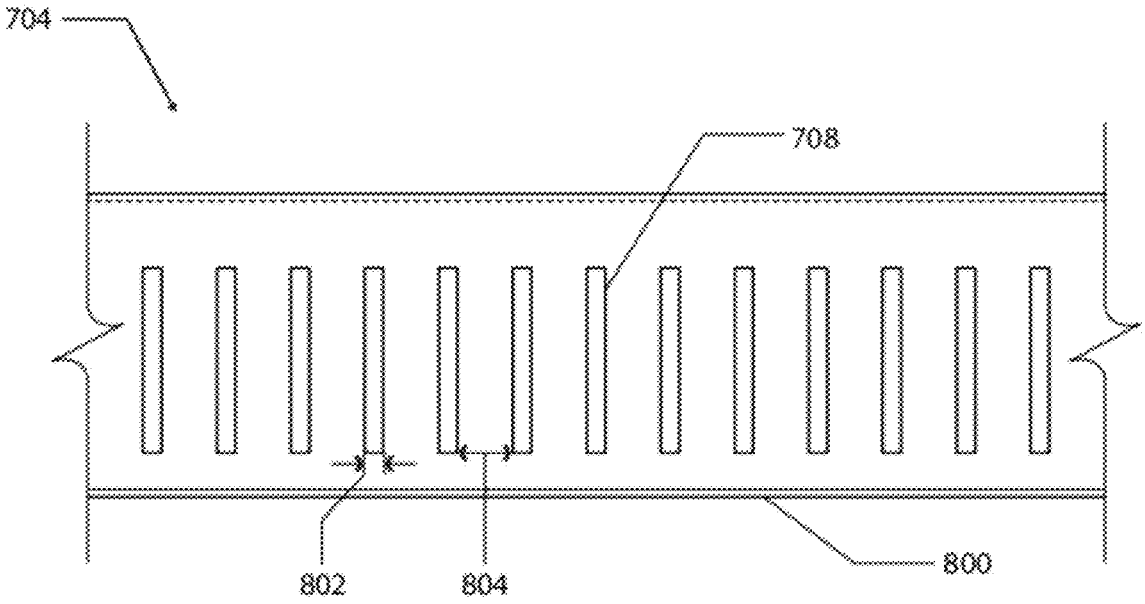
Figure 8F:
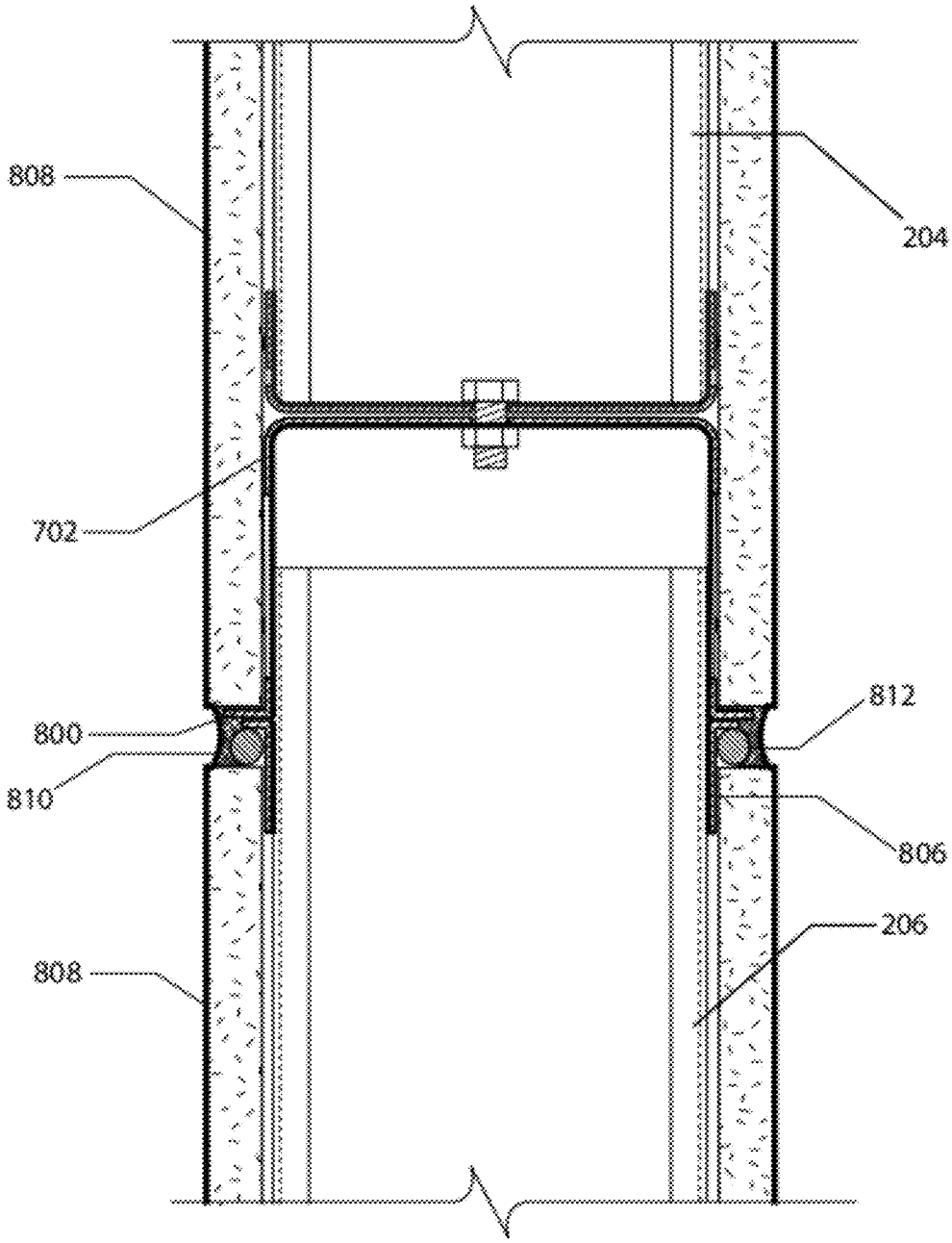
Figure 8G:
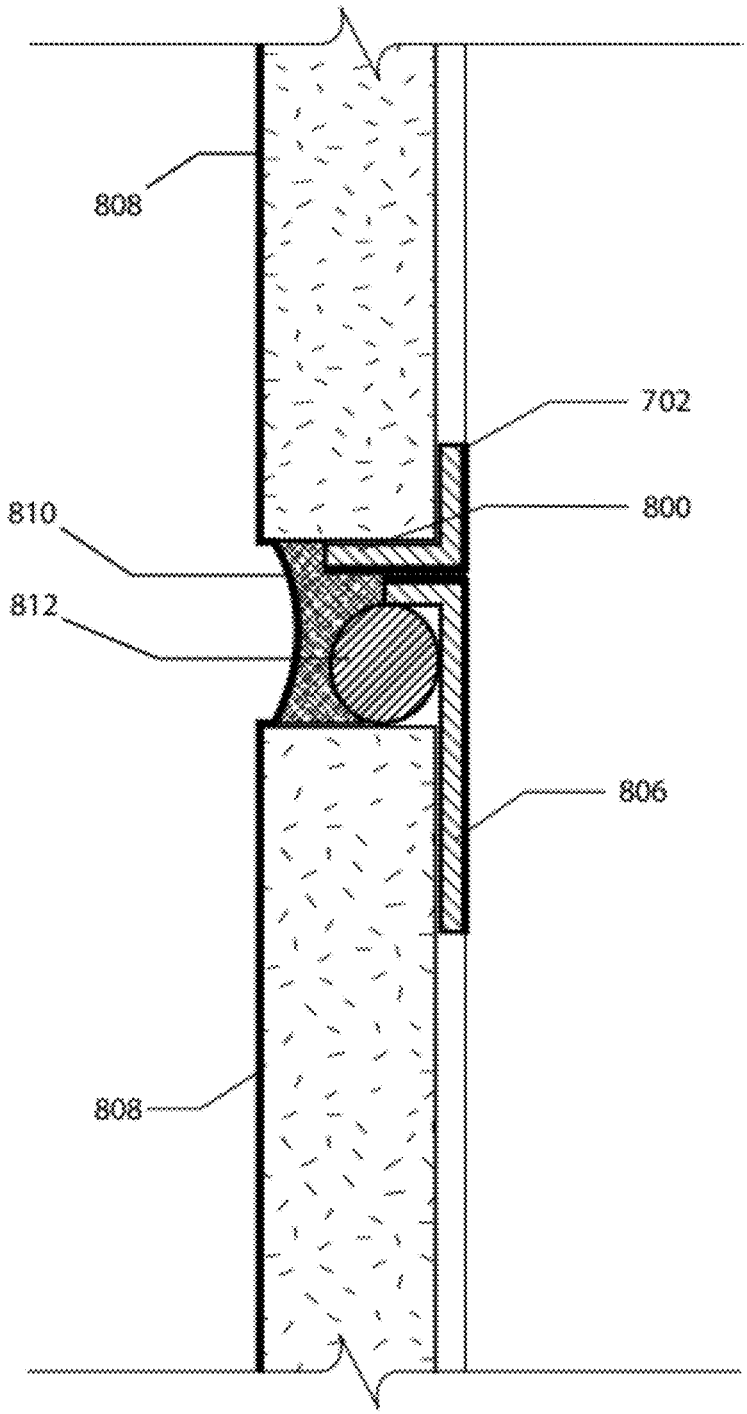

FIG. 8C depicts a developed plan view of the lower receptor structure 702. In one embodiment, the lower receptor structure 702 is designed within a range of measurements. Various measurements for the lower receptor structure 702 may include dimensions A, B, C, D, E, and F, as shown in FIG. 8C, in addition to other measurements. According to one embodiment, the lower receptor structure 702 has dimensions as described below.

Dimension A has a minimum nominal height of 1 inch and a maximum nominal height of 6 inches. Dimension B has a minimum nominal width of 2 inches and a maximum nominal width of 10 inches. Dimension F has a minimum nominal width of ¼ inches and a maximum nominal width of 3 inches. The lower receptor structure 702 includes a maximum length of 25 feet. The lower receptor structure 702 has a minimum gauge of 20 and a maximum gauge of 14. The gauge may indicate a thickness of the material used for the lower receptor structure 702.

Each slot in the lower receptor structure 702 has a minimum width 802 of 1/16 inches and a maximum width 802 of 3/16 inches. The minimum spacing 804 between the slots is 1 inch on center and the maximum spacing 804 is 6 inches on center. Dimension C has a minimum width of ¼ inch, and Dimension E also has a minimum width of ¼ inch. Dimension D, which is the slot length, includes the remaining width of dimension A after subtracting dimensions C and E. The lower receptor structure 702 also includes holes 704 to receive a fastener 710 that attaches the lower receptor structure 702 to the upper receptor structure 700. The holes 704 may be configured according to the type of fastener used and the spacing of holes 704 in the upper receptor structure 700.

The lower receptor structure 702 accommodates variations in construction tolerances of onsite conditions. The construction of floors on each deck and undersides of decks may have ranges of tolerances that can be as high as 1 inch within 10 feet. In one embodiment, the lower receptor structure 702 may absorb a range of variation as much as 3 inches. The lower receptor structure 702 may be installed at a common vertical height to receive any partition assembly that rises above the ceiling line 302.

Figure 9A:
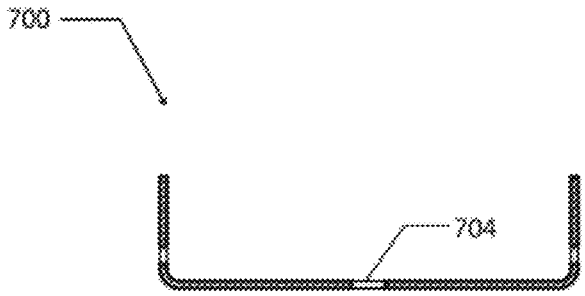
FIGS. 9A-9C depict cross-section, developed plan, and undeveloped plan views of embodiments of an upper receptor structure.
Figure 9B:
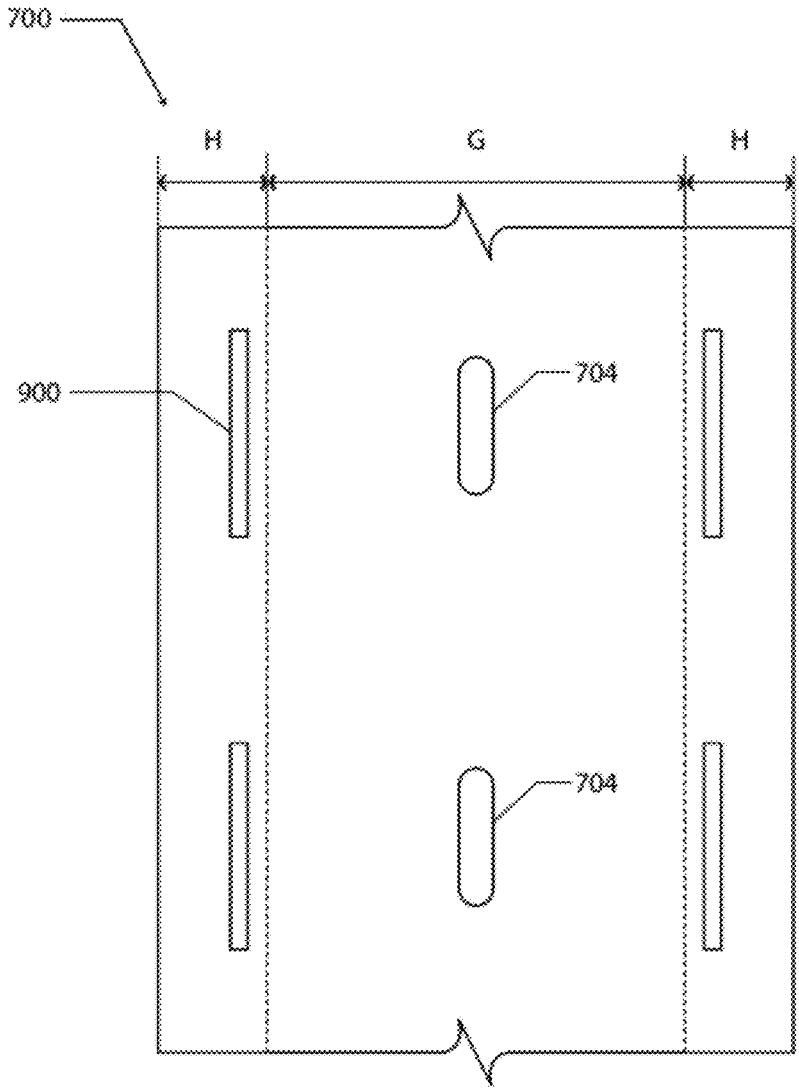
Figure 9C:
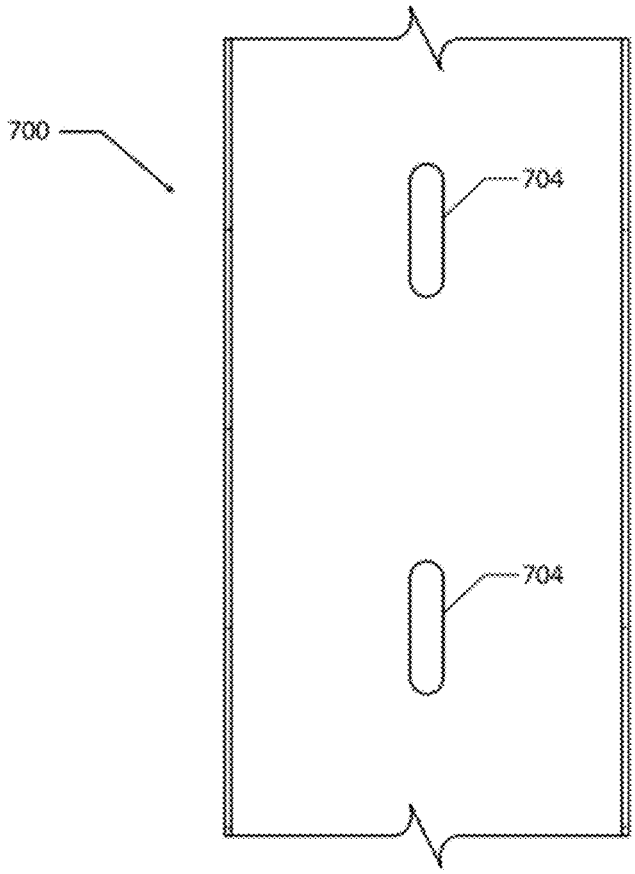

FIGS. 9A-9C depict cross-section, developed plan, and undeveloped plan views of embodiments of an upper receptor structure 700. In some embodiments, the upper receptor structure 700 may be fixed to the upper partition assembly 204. In other embodiments, the upper partition assembly 204 is not fixed to the upper receptor structure 700, but rests in a horizontal track formed by the upper receptor structure 700. The upper receptor structure 700 may include an elongated hole 704 configured to receive a fastener for fastening the upper receptor structure 700 to the lower receptor structure 702. The elongated hole 704 allows for inline movement capability for the modular partition assemblies 300.

The upper receptor structure 700 may also include openings 900 in each side for heavier gauge support elements. In one embodiment, the support element may be the brace 400 as shown in FIG. 4B or the metal strap 404 shown in FIG. 4C. The brace 400 may provide lateral support for the modular partition assemblies 300. The brace 400 may be installed in any of the openings 900 in the upper receptor structure 700. The brace 400 may be a permanent brace 400 for the modular partition assemblies 300. In one embodiment, the upper receptor structure 700 includes a minimum nominal width of 2 inches and a maximum nominal width of 10 inches, and a minimum nominal length of 1⅝ inches and a maximum nominal length of 8 inches.

Figure 10A:
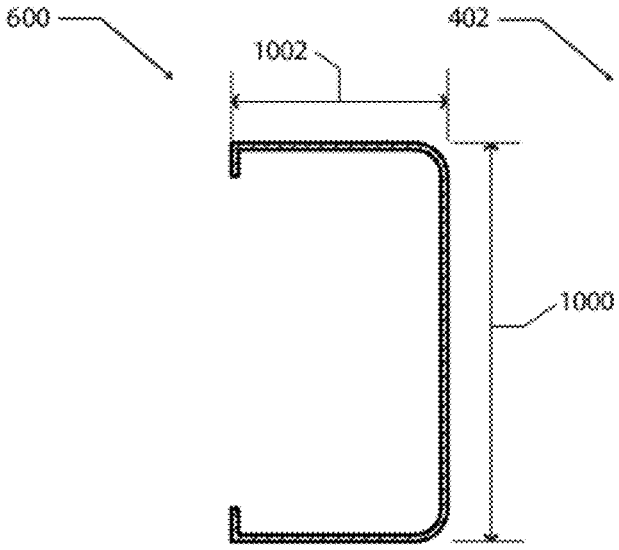
FIGS. 10A-10B depict end cross-section views of embodiments of framing members in the modular partition assemblies of FIG. 6.
Figure 10B:
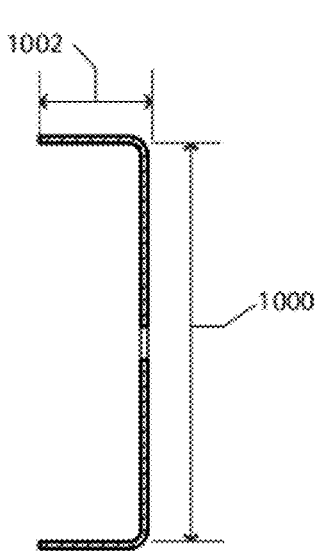

FIGS. 10A-10B depict cross-section views of embodiments of framing members in the interior partition system of FIG. 6. In one embodiment, the framing members include a vertical stud 600, as shown in FIG. 10A, and a horizontal track 402, as shown in FIG. 10B. In one embodiment, the framing members are made of steel sheet stock metal having a minimum gauge of 26 and a maximum gauge of 12. The steel sheet stock metal may be bent into the desired shape. The vertical studs 600 sit in the horizontal track 402 in the lower partition assemblies 206 and are received by the horizontal track 402 in the upper partition assemblies 204.

In one embodiment, the framing members include a minimum nominal width 1002 of 3⅝ inches and a maximum nominal width 1002 of 10 inches. The minimum nominal length 1000 is 1⅝ inches and the maximum nominal length 1000 is 8 inches. Other embodiments may include framing members with different sizes than described herein. In some embodiments, the horizontal tracks 402 may have similar measurements or structure to the upper receptor structures 700.

Figure 11A:
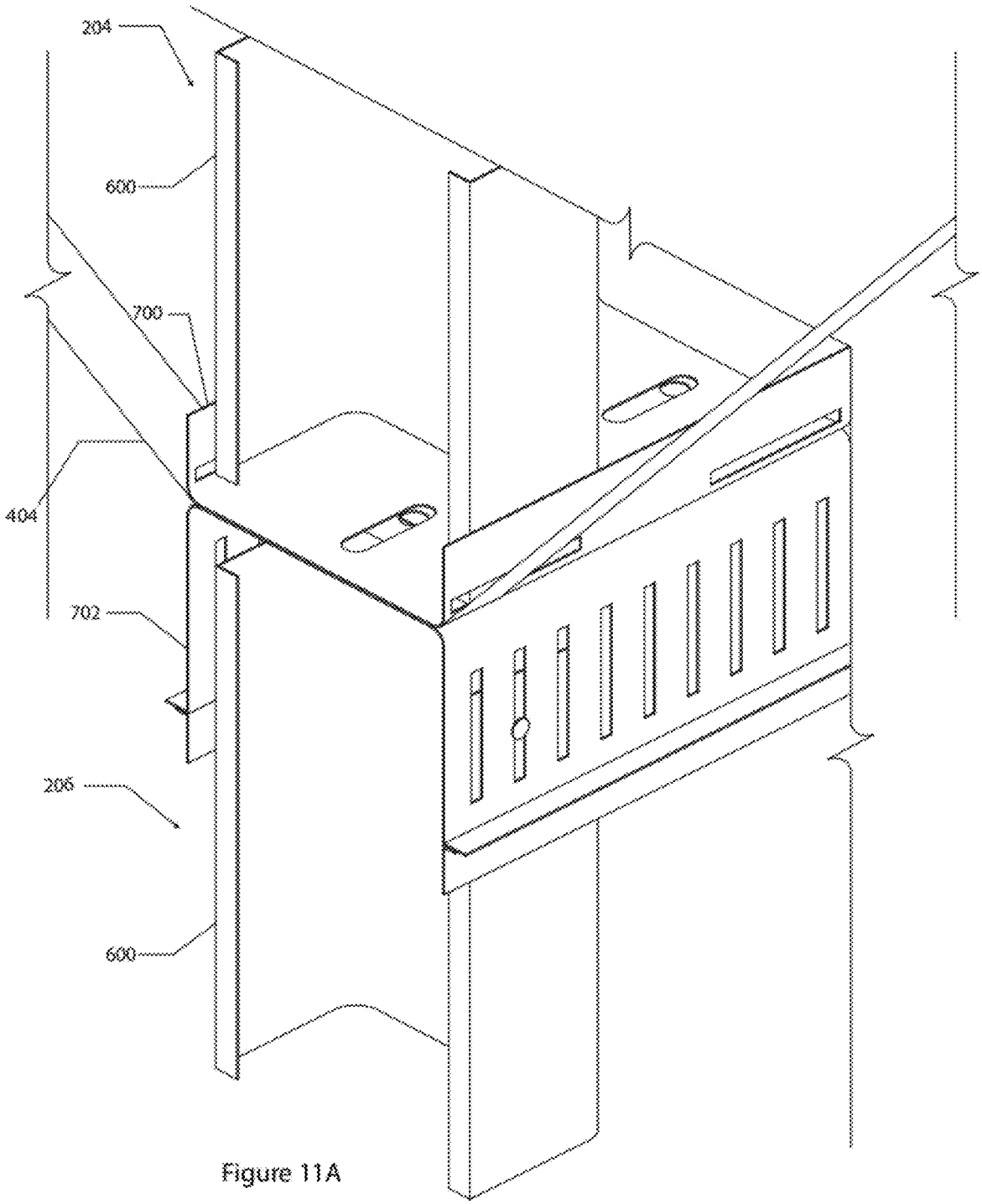
FIG. 11A-11B depict perspective views of various embodiment of a receptor joint for the modular partition assemblies of FIG. 6.
Figure 11B:
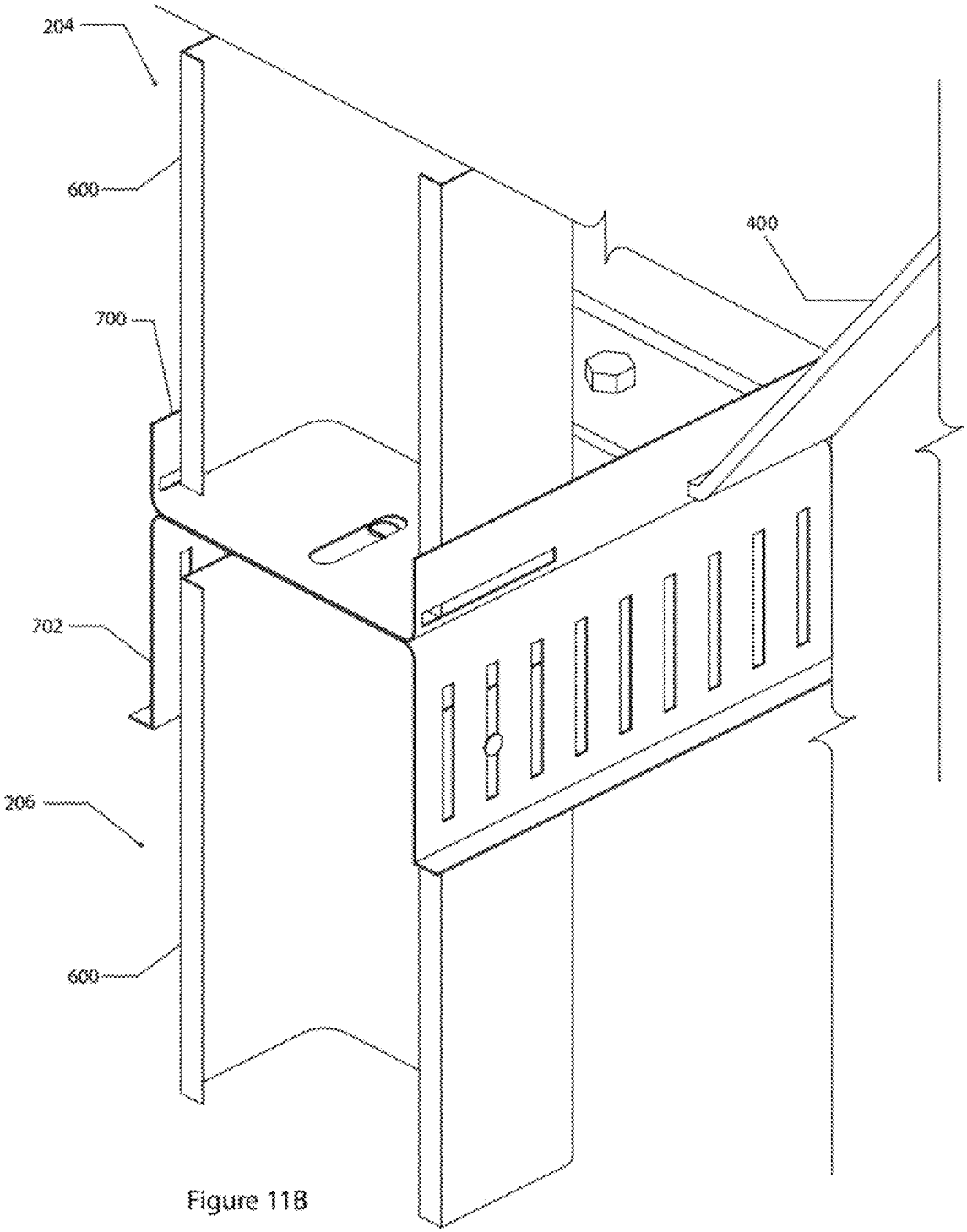

FIGS. 11A-11B depict perspective views of various embodiment of a receptor joint for the interior partition system of FIG. 6. When installed above the ceiling line 302, the receptor joint, which includes the lower receptor structure 702 and the upper receptor structure 700, may be laterally braced at specific locations depending on the performance of the individual partition assemblies. The lower receptor structure 702 and/or the upper receptor structure 700 may include pre-drilled and threaded attachment points between six inches on center and twenty-four inches on center, according to various embodiments. The receptor structure 604 may include an optional metal strap 404 for horizontal bracing, as shown in FIG. 11A. In some embodiments, the bracing may be a temporary bracing during installation of the partition assemblies. In one embodiment, the receptor structure 604 includes a more substantial lateral brace 400 with a heavier gauge than the strap metal and the partition assemblies. The brace 400 may be placed in the openings 900 in the side of the upper receptor structure 700 and fastened to the bottom surface 406 of the upper deck 202.

The receptor joint provides vertical deflection between the interior partition assembly and the lower deck 200. In one embodiment, deflection includes the movement of one level differentiated by the movement or lack of movement of another floor. For example, one deck may have a live load that causes the entire deck to sag compared to another deck that does not have a similar live load. The difference in loading may cause one of the decks to move and cause deflection/stress in the partition assemblies.

The receptor joint may provide predictability in a building life cycle requirement because the receptor joint provides a common height for all partition assemblies and structurally attaches the partition assemblies to the frame structure.

Figure 12:
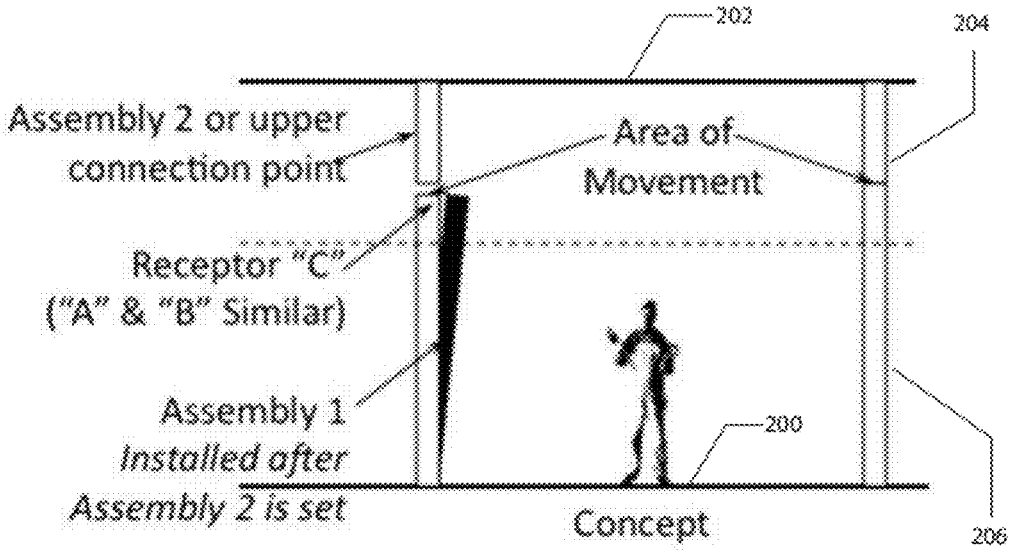
FIG. 12 depicts a side view of one embodiment of the modular partition assemblies of FIG. 6.

FIG. 12 depicts a side view of one embodiment of the modular partition assemblies 204, 206 of FIG. 6. In one embodiment, the upper modular partition assembly is installed first, and then the lower modular partition assembly is installed. The upper partition assembly 204 may be fixed to the upper deck 202, and the lower partition assembly 206 is then moved into place below the upper partition assembly 204 and fixed to the lower deck 200. The upper and lower partition assemblies 204, 206 may be fixed to the upper and lower decks 202, 200, respectively, using the horizontal tracks 402 depicted in FIG. 10B.

The upper and lower receptor structures 700, 702 may be placed (but not necessarily fixed) on the corresponding partition assemblies before or after installing the partition assemblies. In one embodiment, the upper and lower receptor structures 700, 702 are slid onto the corresponding partition assemblies after the partition assemblies are fixed to the corresponding decks, and then the upper and lower receptor structures 700, 702 are fixed to each other and to the partition assemblies.

In one embodiment, an upper and a lower partition assembly 206 are fastened to the respective decks prior to placing the decks in the structural frame 100. The placement of the modular partition assemblies 300 may be such that when the decks are placed in the structural frame 100, the upper partition assembly 204 and the lower partition assembly 206 are placed sufficiently close to each other to be able to connect the upper partition assembly 204 to the lower partition assembly 206 together via the receptor structure 604 without unfastening either of the modular partition assemblies 300 from the decks. This may allow some of the framed building to be pre-assembled onsite or at an offsite location.

Figure 13:
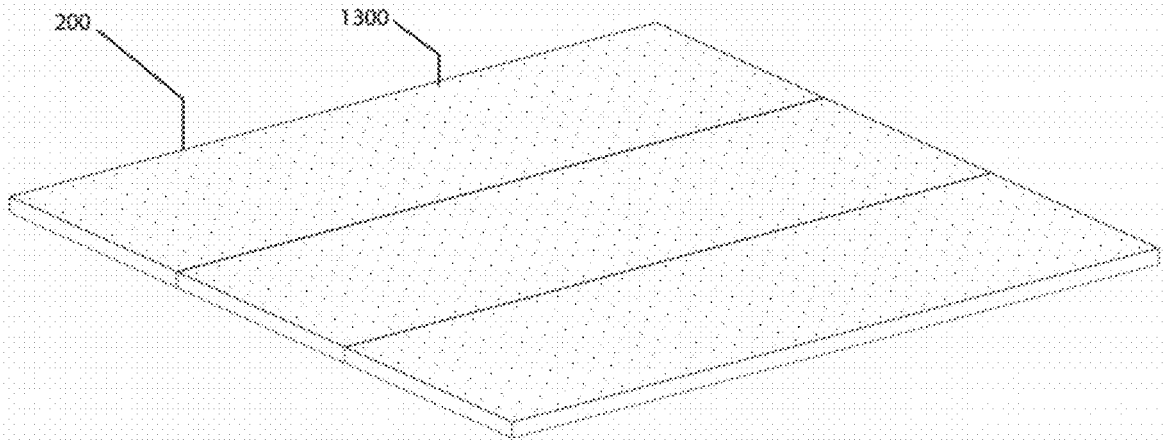
FIG. 13 depicts a perspective view of one embodiment of the lower deck of FIG. 2.

FIG. 13 depicts a perspective view of one embodiment of the lower deck 200 of FIG. 2. In one embodiment, the lower deck 200 includes deck attachment elements affixed within the deck at the top surface of the lower deck 200. The upper deck 202 may also include deck attachment elements 1300 affixed within the deck at the bottom surface 406 of the upper deck 202. The deck attachment elements 1300 may be distributed within the surfaces of the respective decks in a grid pattern, such that the deck attachment elements 1300 are spaced at equal intervals according to a predefined configuration before the deck is installed in the structural frame 100. The intervals in the grid pattern correspond to specific design requirements of the framed building. In some embodiments, the grid pattern for the upper deck 202 may be different than the grid pattern for the lower deck 200. The deck attachment elements 1300 provide for quick and easy attachment of the modular partition assemblies 300 or other building elements to the decks at an array of locations. The attachment elements 1300 may facilitate independent design requirements to assemble components of a newly constructed framed building. Additionally, the attachment elements 1300 may be utilized to adapt the building to changes during the building's lifecycle.

In one embodiment, the attachment elements 1300 are solid tapered and internally threaded cylinders placed in openings or cavities in the decks. In another embodiment, the attachment elements 1300 include channel tracks that are set within the decks and covered with a cap that may be removed on an as-needed basis. The locations of the channel track may correspond to the specific design requirements of the framed building design criteria. Other embodiments of attachment elements 1300 may be used in conjunction with the upper and/or lower decks 202, 200.

The upper partition assemblies 204 may be attached to attachment elements 1300 at the bottom surface 406 of the upper deck 202, and the lower partition assemblies 206 may be attached to attachment elements 1300 at the top surface of the lower deck 200. Other building components may also be attached to attachment elements 1300 in either the upper deck 202 or the lower deck 200.

Figure 14A:
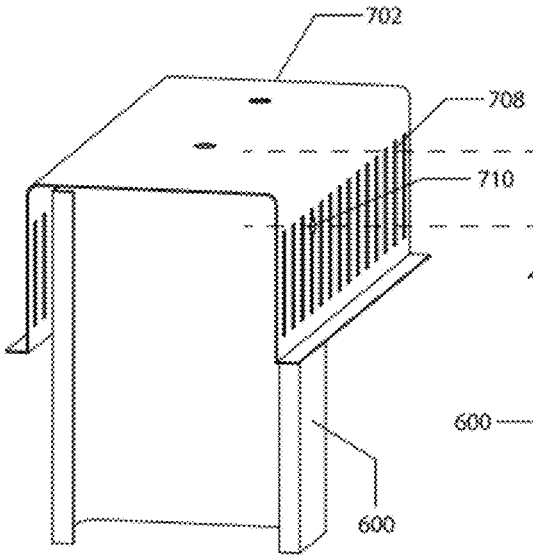
FIGS. 14A-14B depict perspective views of embodiments of receptor structures on a lower modular partition assembly.
Figure 14B:
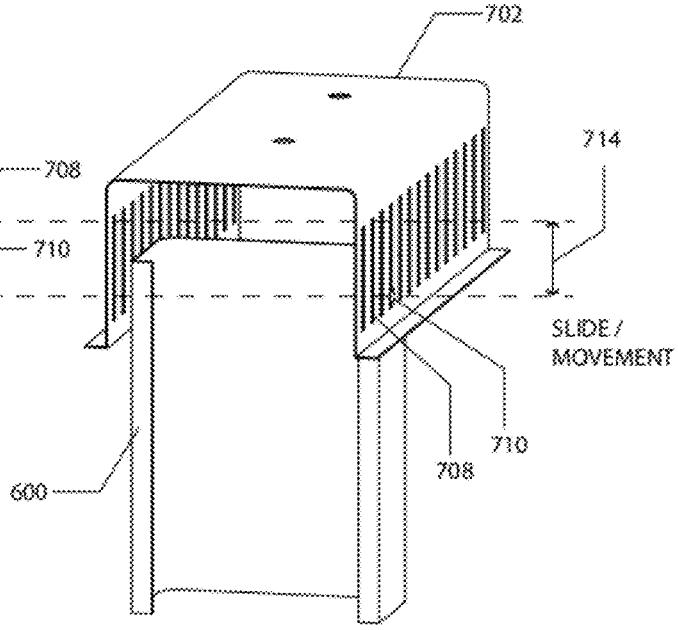

FIGS. 14A-14B depict perspective views of embodiments of receptor structures on a lower modular partition assembly. As described herein, the lower receptor structure 702 may include slots in each side of the lower receptor structure 702. The slots allow the lower receptor structure 702 to be placed on the lower partition assembly 206 during installation or directly after installation of the lower partition assembly 206 in a lowered position, as shown in FIG. 14A.

When the lower receptor structure 702 is in the lowered position, a gap 706 may be present between the lower receptor structure 702 and the upper receptor structure 700. In order to close the gap 706 and secure the upper and lower partition assemblies 204, 206 to each other, the position of the lower receptor structure 702 may be adjusted. In one embodiment, a fastener 710 through one of the slots 708 in the lower receptor structure 702 that is used to secure the lower receptor structure 702 to a vertical stud 600 in the lower partition assembly 206 may be loosened while adjusting the lower receptor structure 702. As shown in FIG. 14B, a vertical position 714 of the lower receptor structure 702 may be adjusted to close the gap 706 between the lower receptor structure 702 and the upper receptor structure 700. When the lower receptor structure 702 is in the desired position, the fastener 710 may be tightened so that the vertical position 714 of the lower receptor structure 702 is fixed with respect to the lower partition assembly 206.

Figure 15:
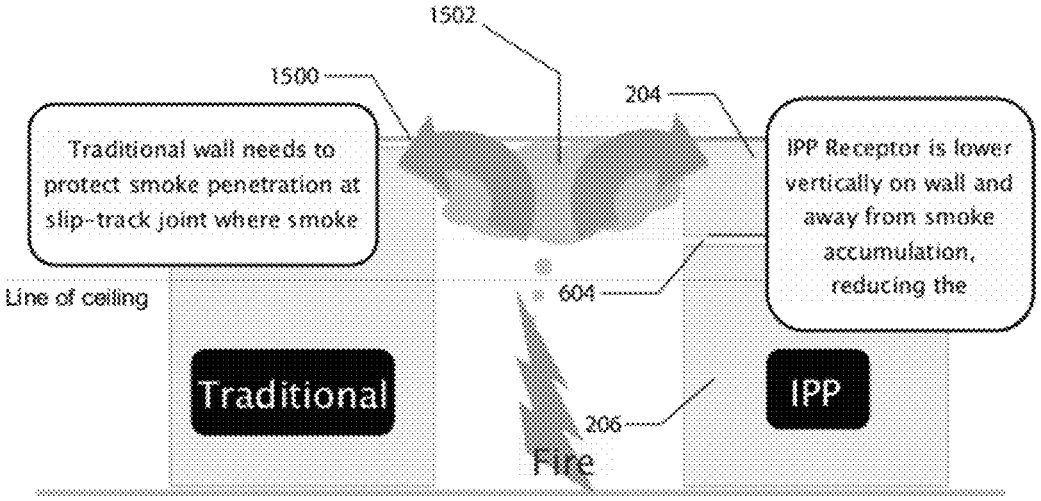
FIG. 15 depicts a side view of one embodiment of modular partition assemblies between decks in the framed building of FIG. 1.

FIG. 15 depicts a side view of one embodiment of modular partition assemblies 300 between decks in the framed building of FIG. 1. As described herein, the head of wall condition for the partition assemblies may determine whether the building structure meets various fire, smoke, and/or noise ratings. A conventional partition assembly that spans the full distance between the lower deck 200 and the upper deck 202 may leave a space 1500 at the head of the partition assembly due to the type of joint or because of variations in the distance between the lower deck 200 and the upper deck 202. Smoke 1502 may pass through the space at the head of the partition assembly, potentially preventing the partition assembly from meeting certain fire or smoke ratings.

The interior partitioning system described herein includes a receptor joint with a lower vertical position on the partition assemblies, thus reducing the chance that smoke 1502 rising and accumulating at the ceiling will be able to transfer through the partition assembly. Additionally, because the upper partition assembly 204 is fixed to the upper deck 202, rather than to the floor, variations in the distance between the lower deck 200 and the upper deck 202 do not affect the position of the upper edge of the upper partition assembly 204 with respect to the upper deck 202. This may allow the upper partition assembly 204 to be installed flush or approximately flush with the upper deck 202, thereby reducing the space between the upper deck 202 and the partition assemblies.

Various embodiments of a non-load bearing interior partition system for a structural frame building have been described above. The interior partition system may be used in conjunction with a method for constructing an occupiable space in a structural frame 100 having a lower deck 200 and an upper deck 202 and having a ceiling line 302 that defines a ceiling height of the occupiable space within the structural frame building.

The method includes fastening the lower modular partition assembly to the lower deck 200 along the lower edge of the lower partition assembly 206, and fastening the upper modular partition assembly to the upper deck 202 along the upper edge of the upper partition assembly 204. After installing the upper and lower partition assemblies 204, 206, the method connects the upper edge of the lower partition assembly 206 to the lower edge of the upper partition assembly 204 via the receptor structure 604. The upper edge of the lower partition assembly 206, the lower edge of the upper partition assembly 204, and the receptor structure 604 are located above the ceiling line 302 of the occupiable space.

In one embodiment, connecting the lower partition assembly 206 to the upper partition assembly 204 via the receptor structure 604 includes adjusting the receptor structure 604 to fill a gap 706 between the upper edge of the lower partition assembly 206 and the lower edge of the upper partition assembly 204. Adjusting the receptor structure 604 may include adjusting a height or vertical dimension of the receptor structure 604 relative to the upper edge of the lower partition assembly 206.

In one embodiment, connecting the upper edge of the lower partition assembly 206 to the lower edge of the upper partition assembly 204 includes securing the receptor structure 604 to the lower edge of the upper partition assembly 204 and/or to the receptor structure 604 to the upper edge of the lower partition assembly 206.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An interior partition system for installation between a lower deck structure and an upper deck structure of a structural frame building, the structural frame building having a ceiling line that defines a ceiling height of occupiable space within the structural frame building, the interior partition system comprising:

a first modular partition assembly for connection to the lower deck structure along a lower edge of the first modular partition assembly;

a second modular partition assembly for connection to the upper deck structure along an upper edge of the second modular partition assembly; and a receptor structure configured to connect an upper edge of the first modular partition assembly to a lower edge of the second modular partition assembly;

wherein the first modular partition assembly has a vertical dimension that exceeds the ceiling height such that the upper edge of the first modular partition assembly, the lower edge of the second modular partition assembly, and the receptor structure are located above the ceiling line upon installation of the first modular partition assembly, the second modular partition assembly, and the receptor structure in the structural frame building;

wherein the receptor structure is configured to accommodate vertical deflection between the lower deck structure and the upper deck structure;

wherein the receptor structure comprises a lower receptor structure configured to receive the upper edge of the first modular partition assembly and an upper receptor structure, which is separate from the lower receptor structure, configured to receive the lower edge of the second modular partition assembly, wherein the lower receptor structure and the upper receptor structure are configured to be fastened together.

2. The interior partition system of claim 1 wherein the lower receptor structure comprises a plurality of vertical slots in each side of the lower receptor structure, wherein the vertical slots are configured to receive a fastener to fasten the lower receptor structure to the first modular partition assembly according to an adjustable vertical position of the lower receptor structure relative to a fixed position of the first modular partition assembly.

3. The interior partition system of claim 1 wherein the receptor comprises a tab on a side of the receptor, wherein the tab is configured to support a wall sheathing.

4. The interior partition system of claim 1 wherein the first modular partition assembly comprises a series of parallel vertical studs and wherein the second modular partition assembly comprises a series of parallel vertical studs.

5. The interior partition system of claim 1 wherein the vertical distance between the lower deck structure and the upper deck structure is in a range of 11-25 feet, the ceiling line is in a range of 7-11 feet, the vertical dimension of the first modular partition assembly is in the range of 8-12 feet, the vertical dimension of the second modular partition assembly is in the range of 3-12 feet.

6. The interior partition system of claim 1 wherein the first modular partition assembly, the second modular partition assembly, and the receptor structure are non-load bearing.

7. The interior partition system of claim 1 wherein the first modular partition assembly, the second modular partition assembly, and the receptor structure form a fire rated interior partition.

8. The interior partition system of claim 1 wherein the first modular partition assembly is fastened to a top surface of the lower deck structure via deck attachment elements that are distributed within the top surface of the lower deck structure in a first predefined grid pattern, and wherein the second modular partition assembly is fastened to a bottom surface of the upper deck structure via deck attachment elements that are distributed within the bottom surface of the upper deck structure in a second predefined grid pattern.

9. The interior partition system of claim 1 wherein the first modular partition and the second modular partition do not vertically overlap.

10. The interior partition system of claim 9 wherein the upper edge of the first modular partition assembly is parallel to and directly below the lower edge of the second modular partition assembly.

11. A occupiable building comprising:

a structural frame defining a footprint of the occupiable building;

at least one lower deck structure located within the footprint of the structural frame and supported by the structural frame;

at least one upper deck structure located within the footprint of the structural frame and supported by the structural frame;

an interior partition system installed between the lower deck structure and the upper deck structure to define an occupiable space, the occupiable space having a ceiling, the interior partition system comprising:

a first modular partition assembly fastened to the lower deck structure along a lower edge of the first modular partition assembly;

a second modular partition assembly fastened to the upper deck structure along an upper edge of the second modular partition assembly; and a receptor structure connecting an upper edge of the first modular partition assembly to a lower edge of the second modular partition assembly;

wherein the upper edge of the first modular partition assembly, the lower edge of the second modular partition assembly, and the receptor structure are located above the ceiling of the occupiable space;

wherein the first modular partition assembly comprises a series of parallel vertical studs and wherein the second modular partition assembly comprises a series of parallel vertical studs; and wherein the first modular partition assembly, the second modular partition assembly, and the receptor structure are non-load bearing.

12. The interior partition system of claim 11 wherein the receptor is configured to accommodate vertical deflection between the lower deck structure and the upper deck structure.

13. The interior partition system of claim 11 wherein the receptor comprises a plurality of vertical slots in each side of the receptor structure, wherein the vertical slots are configured to receive a fastener to fasten the receptor structure to the first modular partition assembly according to an adjustable vertical position of the receptor structure relative to a fixed position of the first modular partition assembly.

14. The interior partition system of claim 11 wherein the first modular partition assembly, the second modular partition assembly, and the receptor structure form a fire rated interior partition.

15. A method for constructing an occupiable space in a structural frame building, the structural frame building having a lower deck structure and an upper deck structure and the occupiable space having a ceiling line that defines a ceiling height of the occupiable space within the structural frame building, the method comprising:

fastening a first modular partition assembly to the lower deck structure along a lower edge of the first partition assembly;

fastening a second modular partition assembly to the upper deck structure along an upper edge of the second modular partition assembly; and connecting an upper edge of the first modular partition assembly to a lower edge of the second modular partition assembly via a receptor structure, wherein the upper edge of the first modular partition assembly, the lower edge of the second modular partition assembly, and the receptor structure are located above the ceiling line of the occupiable space;

wherein the receptor structure is configured to accommodate vertical deflection between the lower deck structure and the upper deck structure;

wherein the first modular partition assembly comprises a series of parallel vertical studs and wherein the second modular partition assembly comprises a series of parallel vertical studs;

wherein the first modular partition assembly, the second modular partition assembly, and the receptor structure are non-load bearing;

wherein the first modular partition assembly, the second modular partition assembly, and the receptor structure form a fire rated interior partition.

16. The method of claim 15 wherein connecting an upper edge of the first modular partition assembly to a lower edge of the second modular partition assembly via a receptor structure comprises adjusting the height of the receptor structure to fill a gap between the upper edge of the first modular partition assembly and the lower edge of the second modular partition assembly.

17. The method of claim 15 wherein connecting an upper edge of the first modular partition assembly to a lower edge of the second modular partition assembly via a receptor structure further comprises securing the receptor structure to the lower edge of the second modular partition assembly.

18. The method of claim 15 wherein connecting an upper edge of the first modular partition assembly to a lower edge of the second modular partition assembly via a receptor structure further comprises securing the receptor structure to the upper edge of the first modular partition assembly.

19. The method of claim 15 wherein connecting an upper edge of the first modular partition assembly to a lower edge of the second modular partition assembly via a receptor structure comprises adjusting the receptor structure to fill a gap between the upper edge of the first modular partition assembly and the lower edge of the second modular partition assembly.

20. The method of claim 15 wherein the vertical distance between the lower deck structure and the upper deck structure is in a range of 11-25 feet, the ceiling line is in a range of 7-11 feet, the vertical dimension of the first modular partition assembly is in the range of 8-12 feet, the vertical dimension of the second modular partition assembly is in the range of 3-12 feet.

21. The method of claim 15 wherein the first modular partition assembly is fastened to a top surface of the lower deck structure, and wherein the second modular partition assembly is fastened to a bottom surface of the upper deck assembly.

22. The method of claim 15 wherein the first modular partition assembly is fastened to the top surface of the lower deck structure via attachment elements that are distributed within the top surface of the lower deck structure in a first predefined grid pattern, and wherein the second modular partition assembly is fastened to the bottom surface of the upper deck structure via attachment elements that are distributed within the bottom surface of the upper deck structure in a second predefined grid pattern.

23. An interior partition system for installation between a lower deck structure and an upper deck structure of a structural frame building, the structural frame building having a ceiling line that defines a ceiling height of occupiable space within the structural frame building, the interior partition system comprising:

a first modular partition assembly for connection to the lower deck structure along a lower edge of the first modular partition assembly;

a second modular partition assembly for connection to the upper deck structure along an upper edge of the second modular partition assembly; and a receptor structure configured to connect an upper edge of the first modular partition assembly to a lower edge of the second modular partition assembly;

wherein the first modular partition assembly has a vertical dimension that exceeds the ceiling height such that the upper edge of the first modular partition assembly, the lower edge of the second modular partition assembly, and the receptor structure are located above the ceiling line upon installation of the first modular partition assembly, the second modular partition assembly, and the receptor structure in the structural frame building;

wherein the receptor structure is configured to accommodate vertical deflection between the lower deck structure and the upper deck structure;

wherein the first modular partition assembly comprises a series of parallel vertical studs and wherein the second modular partition assembly comprises a series of parallel vertical studs;

wherein the vertical distance between the lower deck structure and the upper deck structure is in a range of 11-25 feet, the ceiling line is in a range of 7-11 feet, the vertical dimension of the first modular partition assembly is in the range of 8-12 feet, the vertical dimension of the second modular partition assembly is in the range of 3-12 feet;

wherein the first modular partition assembly, the second modular partition assembly, and the receptor structure are non-load bearing.

24. An interior partition system for installation between a lower deck structure and an upper deck structure of a structural frame building, the structural frame building having a ceiling line that defines a ceiling height of occupiable space within the structural frame building, the interior partition system comprising:

a first modular partition assembly for connection to the lower deck structure along a lower edge of the first modular partition assembly;

a second modular partition assembly for connection to the upper deck structure along an upper edge of the second modular partition assembly; and a receptor structure configured to connect an upper edge of the first modular partition assembly to a lower edge of the second modular partition assembly;

wherein the first modular partition assembly has a vertical dimension that exceeds the ceiling height such that the upper edge of the first modular partition assembly, the lower edge of the second modular partition assembly, and the receptor structure are located above the ceiling line upon installation of the first modular partition assembly, the second modular partition assembly, and the receptor structure in the structural frame building;

wherein the receptor structure is configured to accommodate vertical deflection between the lower deck structure and the upper deck structure;

wherein the receptor structure comprises a lower receptor structure configured to receive the upper edge of the first modular partition assembly and an upper receptor structure, which is separate from the lower receptor structure, configured to receive the lower edge of the second modular partition assembly, wherein the lower receptor structure and the upper receptor structure are configured to be fastened together;

wherein the lower receptor structure comprises a plurality of vertical slots in each side of the lower receptor structure, wherein the vertical slots are configured to receive a fastener to fasten the lower receptor structure to the first modular partition assembly according to an adjustable vertical position of the lower receptor structure relative to a fixed position of the first modular partition assembly;

wherein the first modular partition assembly comprises a series of parallel vertical studs and wherein the second modular partition assembly comprises a series of parallel vertical studs;

wherein the vertical distance between the lower deck structure and the upper deck structure is in a range of 11-25 feet, the ceiling line is in a range of 7-11 feet, the vertical dimension of the first modular partition assembly is in the range of 8-12 feet, the vertical dimension of the second modular partition assembly is in the range of 3-12 feet;

wherein the first modular partition assembly, the second modular partition assembly, and the receptor structure are non-load bearing;

wherein the first modular partition assembly, the second modular partition assembly, and the receptor structure form a fire rated interior partition.

* * * * *